US010269311B2

(12) United States Patent
de Greef et al.

(10) Patent No.: US 10,269,311 B2
(45) Date of Patent: Apr. 23, 2019

(54) CONTROL SYSTEM FOR AN ELECTROWETTING DISPLAY DEVICE WITH MEMORY CONTROLLER

(71) Applicant: Amazon Technologies, Inc., Seattle, WA (US)

(72) Inventors: Petrus Maria de Greef, Waalre (NL); Anthony Botzas, San Jose, CA (US); Robert Waverly Zehner, Sunnyvale, CA (US); Jozef Elisabeth Aubert, Roermond (NL); Johannes Wilhelmus Hendrikus Mennen, Budel (NL)

(73) Assignee: Amazon Technologies, Inc., Seattle, WA (US)

( * ) Notice: Subject to any disclaimer, the term of this patent is extended or adjusted under 35 U.S.C. 154(b) by 301 days.

(21) Appl. No.: 15/383,692

(22) Filed: Dec. 19, 2016

(65) Prior Publication Data

US 2018/0174529 A1 Jun. 21, 2018

(51) Int. Cl.

| | |
|---|---|
| ***G09G 3/34*** | (2006.01) |
| ***G09G 3/20*** | (2006.01) |
| ***G09G 5/399*** | (2006.01) |

(52) U.S. Cl.

CPC ..... *G09G 3/348* (2013.01); *G09G 3/2092* (2013.01); *G09G 5/399* (2013.01); (Continued)

(58) Field of Classification Search

CPC ..... G09G 2340/16; G09G 2320/0252
See application file for complete search history.

(56) References Cited

U.S. PATENT DOCUMENTS 6,778,160 B2 * 8/2004 Kubota ..... G09G 3/3611 345/690
7,292,382 B2 * 11/2007 Fujimori ..... G02F 1/055 345/84

(Continued)

FOREIGN PATENT DOCUMENTS

| | | |
|---|---|---|
| EP | 07788696 | 6/1997 |
| EP | 1748405 | 1/2007 |

(Continued)

OTHER PUBLICATIONS

International Search Report and Written Opinion of related International Patent Application No. PCT/US2017/066452, dated Jun. 1, 2018.

(Continued)

*Primary Examiner* — Gene W Lee
(74) *Attorney, Agent, or Firm* — Quarles and Brady LLP

(57) ABSTRACT

An electrowetting display device includes a plurality of pixels and a packaged integrated circuit that includes an output pin configured to electrically connect to a display driver, a rendering engine configured to output an initial luminance value for a first pixel in a plurality of pixels, and a memory controller. The memory controller includes a first frame buffer storing a current luminance value for the first pixel, a second frame buffer, and a front-end interface controller configured to encode a next luminance value. The next luminance value is at least partially determined by the initial luminance value for the first pixel. The memory controller includes a back-end interface controller configured to transmit a data signal through the output pin to the display driver to cause the display driver to apply a driving voltage to the first pixel. The driving voltage is at least partially determined by the current luminance value.

20 Claims, 14 Drawing Sheets

(52) U.S. Cl.
CPC ..... *G09G 2310/0267* (2013.01); *G09G 2310/0275* (2013.01); *G09G 2320/0252* (2013.01); *G09G 2340/16* (2013.01); *G09G 2360/16* (2013.01); *G09G 2360/18* (2013.01)

(56) References Cited

U.S. PATENT DOCUMENTS

| | | | | |
|---|---|---|---|---|
| 7,786,967 | B2 * | 8/2010 | Kim | G09G 3/3648 345/89 |
| 7,859,497 | B2 * | 12/2010 | Kong | G09G 3/3648 345/100 |
| 7,898,513 | B2 * | 3/2011 | Kong | G09G 3/2092 345/204 |
| 7,952,552 | B2 * | 5/2011 | Kong | G09G 3/3648 345/94 |
| 8,248,535 | B2 * | 8/2012 | He | H04N 5/20 348/565 |
| 9,256,064 | B1 | 2/2016 | Sprague et al. | |
| 2007/0263005 | A1 | 11/2007 | Huang et al. | |
| 2008/0084524 | A1 | 4/2008 | Inuzuka et al. | |
| 2009/0091524 | A1 | 4/2009 | Lomas | |
| 2010/0208142 | A1 * | 8/2010 | He | H04N 5/20 348/671 |
| 2013/0106821 | A1 | 5/2013 | Aubert et al. | |
| 2015/0279284 | A1 | 10/2015 | Yano et al. | |
| 2016/0178892 | A1 | 6/2016 | De Greef | |

FOREIGN PATENT DOCUMENTS

| | | |
|---|---|---|
| EP | 2388773 | 11/2011 |
| WO | 2014176623 | 11/2014 |

OTHER PUBLICATIONS

International Search Report and Written Opinion of related International Patent Application No. PCT/US2017/066471, dated Feb. 19, 2018.

International Search Report and Written Opinion of related International Patent Application No. PCT/US2017/066469, dated Feb. 20, 2018.

Jeong Byung Chae et al., Enhancement of Response Speed of Viscous Fluids Using Overdrive Voltage, Sensors and Actuators B: Chemical, vol. 209, p. 56-60, 2015.

* cited by examiner

| | | | | New Values | |
|---|---|---|---|---|---|
| Addressed | Prev | Current | Input | Current | Next |
| Y | 0 | Nonzero | IN | Nonzero | IN |
| N | 0 | Nonzero | IN | Overdrive | IN |
| Y | N/A | 0* | IN | 0 | IN |
| N | N/A | 0* | IN | 0 | IN |
| Y | Nonzero | Nonzero | 0 | No change | 0 |
| N | Nonzero | Nonzero | 0 | No change | 0* |

| Prev/Next | Current | Drive Scheme |
|---|---|---|
| 0 | Nonzero | Overdrive |
| Nonzero | Nonzero | Current |
| N/A | 0* | 0 |
| 0* | Nonzero | Current |

CONTROL SYSTEM FOR AN ELECTROWETTING DISPLAY DEVICE WITH MEMORY CONTROLLER

BACKGROUND

Electronic displays are found in numerous types of electronic devices including, without limitation, electronic book ("eBook") readers, mobile phones, laptop computers, desktop computers, televisions, appliances, automotive electronics, and augmented reality devices. Electronic displays may present various types of information, such as user interfaces, device operational status, digital content items, and the like, depending on the kind and purpose of the associated device. The appearance and quality of a display may affect a user's experience with the electronic device and the content presented thereon. Accordingly, enhancing user experience and satisfaction continues to be a priority. Moreover, increased multimedia use imposes high demands on designing, packaging, and fabricating display devices, as content available for mobile use becomes more extensive and device portability continues to be a high priority to the consumer.

An electrowetting display includes an array of pixels individually bordered by pixel walls that retain liquid, such as an opaque oil, for example. Light transmission through each pixel is adjustable by electronically controlling a position of the liquid in the pixel.

BRIEF DESCRIPTION OF THE DRAWINGS

The detailed description is set forth with reference to the accompanying figures. The use of the same reference numbers in different figures indicates similar or identical items or features.

DETAILED DESCRIPTION

Figure 1A:
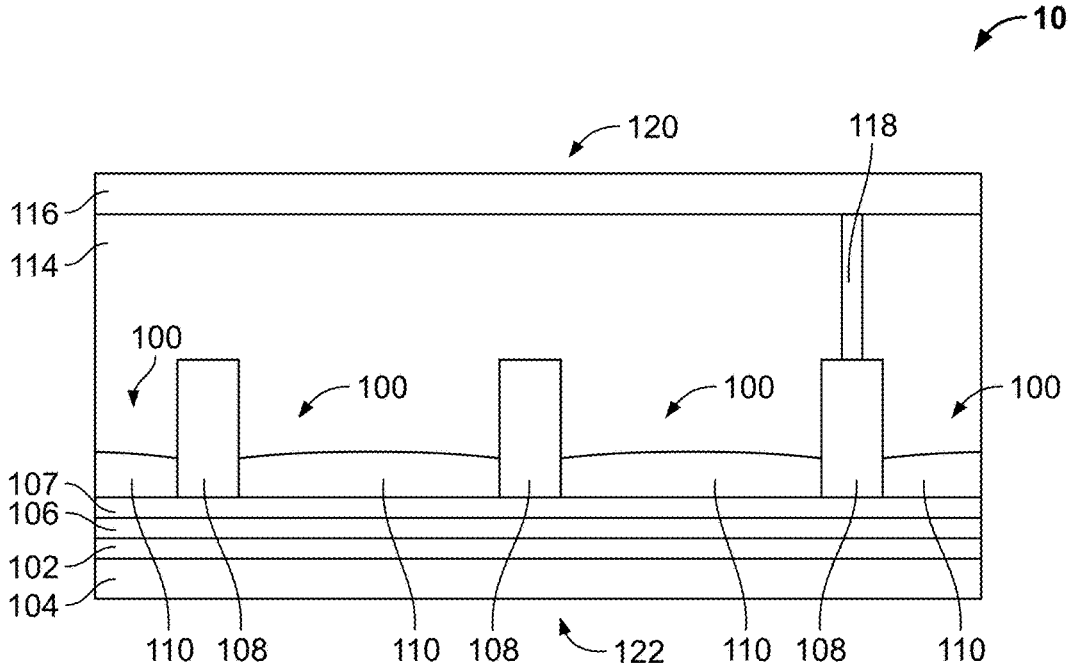
FIGS. 1A and 1B illustrate a cross-section of a portion of an electrowetting display device, according to various embodiments.

In various embodiments described herein, electronic devices include electrowetting displays for presenting content and other information. In some examples, the electronic devices may include one or more components associated with the electrowetting display, such as a touch sensor component layered atop the electrowetting display for detecting touch inputs, a front light or back light component for lighting the electrowetting display, and/or a cover layer component, which may include antiglare properties, antireflective properties, anti-fingerprint properties, anti-cracking properties, and the like.

An electrowetting pixel is defined by a number of pixel walls that surround or are otherwise associated with at least a portion of the electrowetting pixel. The pixel walls form a structure that is configured to contain at least a portion of a first liquid, such as an opaque oil. Light transmission through the electrowetting pixel can be controlled by an application of an electric potential to the electrowetting pixel, which results in a movement of a second liquid, such as an electrolyte solution, into the electrowetting pixel, thereby displacing the first liquid.

When the electrowetting pixel is in a rest state (i.e., with no electric potential applied), the opaque oil is distributed throughout the pixel. The oil absorbs light and the pixel in this conditional appears black. But when the electric potential or driving voltage is applied to the pixel, the oil is displaced to one side of the pixel. Light can then enter the pixel striking a reflective surface. The light then reflects out of the pixel, causing the pixel to appear white to an observer. If the reflective surface only reflects a portion of the light spectrum or if light filters are incorporated into the pixel structure, the pixel may appear to have color. The magnitude of the driving voltage affects the degree to which the pixel opens and, thereby, the pixel's apparent luminance or brightness to a viewer.

The present disclosure provides a control system for an electrowetting display device. The control system may be implemented within an integrated circuit as an application specific integrated circuit (ASIC). The control system is configured to receive conventional red, green, blue (RGB) input data from an external component, such as a host processor. The RGB input data maps a particular color to a target location or pixel within a source image. The control system process that RGB input data into luminance data that can be used to establish driving voltages for the pixels in an electrowetting display panel so as to accurately recreate the image specified by the source RGB input data. As described herein, the display panel may be configured in a PENTILE arrangement that includes pixels including red, green, blue, and white (RGBW) sub-pixels.

The control system is configured to convert the input RGB data from a video domain into a luminance domain. Once converted, the control system converts the RGB data into data in the RGBW color space that specifies luminance values for each of the RGBW sub-pixels found in each pixel of the present display panel.

In some cases, particular luminance levels (e.g., those luminance levels representing low greyscale luminance levels) can be difficult to achieve in an electrowetting pixel. This can be because the oil movement within a sub-pixel can exhibit hysteresis, making oil position difficult to accurately predict based upon driving voltage. This effect is particularly evident at lower driving voltages that correspond to low greyscale values for the sub-pixel. To reduce the effects of hysteresis at low greyscale values and corresponding driving voltages, the present control system is configured to implement a low greyscale rendering approach that involves quantizing the RGBW luminance values so as to avoid greyscale values that are difficult to achieve. Because the quantization process can generate some error in the actual greyscale output of a sub-pixel in the display panel, the control system also implements a dithering process enabling any such error to be distributed to other neighboring pixels. The dithering process can reduce the likelihood that the quantization process results in visual artifacts that are noticeable to a viewer of the display device.

The control system also includes an output system including an output memory controller and frame buffer. The output system receives frames of processed RGBW data and uses that data to supply driving voltages to the pixels of the display panel. The output system includes two separate frame buffers, each configured to store an entire frame of RGBW data. During operation, the output system alternates which frame buffer is used to store the RGBW data that is currently being displayed via the display panel and which frame buffer stores RGBW data for the upcoming or next frame.

When transitioning from a fully closed state to a partially open state, the oil in the electrowetting pixel can move sluggishly. To enhance the oil movement and ensure that the electrowetting pixel opens by the desired amount, the pixel can be temporarily driven with a driving voltage greater than that necessary to achieve the desired luminance level. This is referred to as overdriving the pixel. The present output system is configured to analyze the RGBW data in both frame buffers in order to detect circumstances that require the temporary overdriving of one or more pixels in the display panel. If such a circumstance is detected, the output system implements a temporary overdrive condition to ensure that the pixel is opened by the desired amount.

A display device, such as an electrowetting display device, may be a transmissive, reflective or transflective display that generally includes an array of pixels, which comprise a number of sub-pixels, configured to be operated by an active matrix addressing scheme. For example, rows and columns of electrowetting pixels (and their sub-pixels) are operated by controlling voltage levels on a plurality of source lines and gate lines. In this fashion, the display device may produce an image by selecting particular pixels or sub-pixels to transmit, reflect or block light. Sub-pixels are addressed (e.g., selected) via rows and columns of the source lines and the gate lines that are electrically connected to transistors (e.g., used as switches) included in each sub-pixel. The transistors take up a relatively small fraction of the area of each pixel to allow light to efficiently pass through (or reflect from) the display pixel. Herein, a pixel may, unless otherwise specified, be made up of two or more sub-pixels of an electrowetting display device. Such a pixel or sub-pixel may be the smallest light transmissive, reflective or transflective pixel of a display that is individually operable to directly control an amount of light transmission through or reflection from the pixel. For example, in some embodiments, a pixel may comprise a red sub-pixel, a green sub-pixel, and a blue sub-pixel. In other embodiments, a pixel may be a smallest component, e.g., the pixel does not include any sub-pixels. Accordingly, embodiments of the present system may be equally applicable to controlling the state (e.g., luminance value or driving voltage) of sub-pixels or pixels in various display devices.

Electrowetting displays include an array of pixels and sub-pixels sandwiched between two support plates, such as a bottom support plate and a top support plate. For example, a bottom support plate in cooperation with a top support plate may contain sub-pixels that include electrowetting oil, electrolyte solution and pixel walls between the support plates. Support plates may include glass, plastic (e.g., a transparent thermoplastic such as a poly(methyl methacrylate) (PMMA) or other acrylic), or other transparent material and may be made of a rigid material or a flexible material, for example. Sub-pixels include various layers of materials built upon a bottom support plate. One example layer is an amorphous fluoropolymer (AF) with hydrophobic behavior, around portions of which pixel walls are built.

Hereinafter, example embodiments include, but are not limited to, reflective electrowetting displays that include a clear or transparent top support plate and a bottom support plate, which need not be transparent. The clear top support plate may comprise glass or any of a number of transparent materials, such as transparent plastic, quartz, and semiconductors, for example, and claimed subject matter is not limited in this respect. "Top" and "bottom" as used herein to identify the support plates of an electrowetting display do not necessarily refer to a direction referenced to gravity or to a viewing side of the electrowetting display. Also, as used herein for the sake of convenience of describing example embodiments, the top support plate is that through which viewing of pixels of a (reflective) electrowetting display occurs.

In some embodiments, a reflective electrowetting display comprises an array of pixels and sub-pixels sandwiched between a bottom support plate and a top support plate. The bottom support plate may be opaque while the top support plate is transparent. Herein, describing a pixel, sub-pixel, or material as being "transparent" means that the pixel or material may transmit a relatively large fraction of the light incident upon it. For example, a transparent material or layer may transmit more than 70% or 80% of the light impinging on its surface, though claimed subject matter is not limited in this respect.

Sub-pixel walls retain at least a first fluid which is electrically non-conductive, such as an opaque or colored oil, in the individual pixels. A cavity formed between the support plates is filled with the first fluid (e.g., retained by pixel walls) and a second fluid (e.g., considered to be an electrolyte solution) that is electrically conductive or polar and may be a water or a salt solution such as a solution of potassium chloride water. The second fluid may be transparent, but may be colored, or light-absorbing. The second fluid is immiscible with the first fluid.

Individual reflective electrowetting sub-pixels may include a reflective layer on the bottom support plate of the electrowetting sub-pixel, a transparent electrode layer adjacent to the reflective layer, and a hydrophobic layer on the electrode layer. Pixel walls of each sub-pixel, the hydrophobic layer, and the transparent top support plate at least partially enclose a liquid region that includes an electrolyte solution and an opaque liquid, which is immiscible with the electrolyte solution. An "opaque" liquid, as described herein, is used to describe a liquid that appears black to an observer. For example, an opaque liquid strongly absorbs a broad spectrum of wavelengths (e.g., including those of red, green and blue light) in the visible region of electromagnetic radiation. In some embodiments, the opaque liquid is a nonpolar electrowetting oil.

The opaque liquid is disposed in the liquid region. A coverage area of the opaque liquid on the bottom hydrophobic layer is electrically adjustable to affect the amount of light incident on the reflective electrowetting display that reaches the reflective material at the bottom of each pixel.

In addition to pixels, spacers and edge seals may also be located between the two support plates. The support plates may comprise any of a number of materials, such as plastic, glass, quartz, and semiconducting materials, for example, and claimed subject matter is not limited in this respect.

Spacers and edge seals which mechanically connect the first support plate with the second overlying support plate, or which form a separation between the first support plate and the second support plate, contribute to mechanical integrity of the electrowetting display. Edge seals, for example, being disposed along a periphery of an array of electrowetting pixels, may contribute to retaining fluids (e.g., the first and second fluids) between the first support plate and the second overlying support plate. Spacers can be at least partially transparent so as to not hinder throughput of light in the electrowetting display. The transparency of spacers may at least partially depend on the refractive index of the spacer material, which can be similar to or the same as the refractive indices of surrounding media. Spacers may also be chemically inert to surrounding media.

In some embodiments, a display device as described herein may comprise a portion of a system that includes one or more processors and one or more computer memories, which may reside on a control board, for example. Display software may be stored on the one or more memories and may be operable with the one or more processors to modulate light that is received from an outside source (e.g., ambient room light) or out-coupled from a lightguide of the display device. For example, display software may include code executable by a processor to modulate optical properties of individual pixels of the electrowetting display based, at least in part, on electronic signals representative of image and/or video data. The code may cause the processor to modulate the optical properties of pixels by controlling electrical signals (e.g., voltages, currents, and fields) on, over, and/or in layers of the electrowetting display.

Figure 1B:
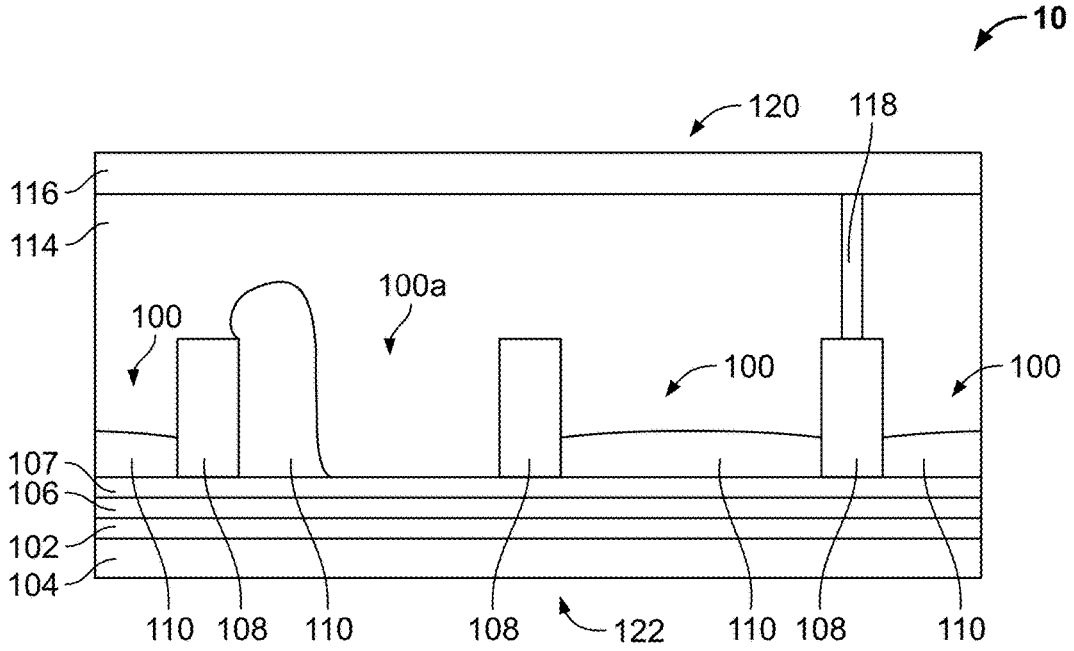
Figure 2:
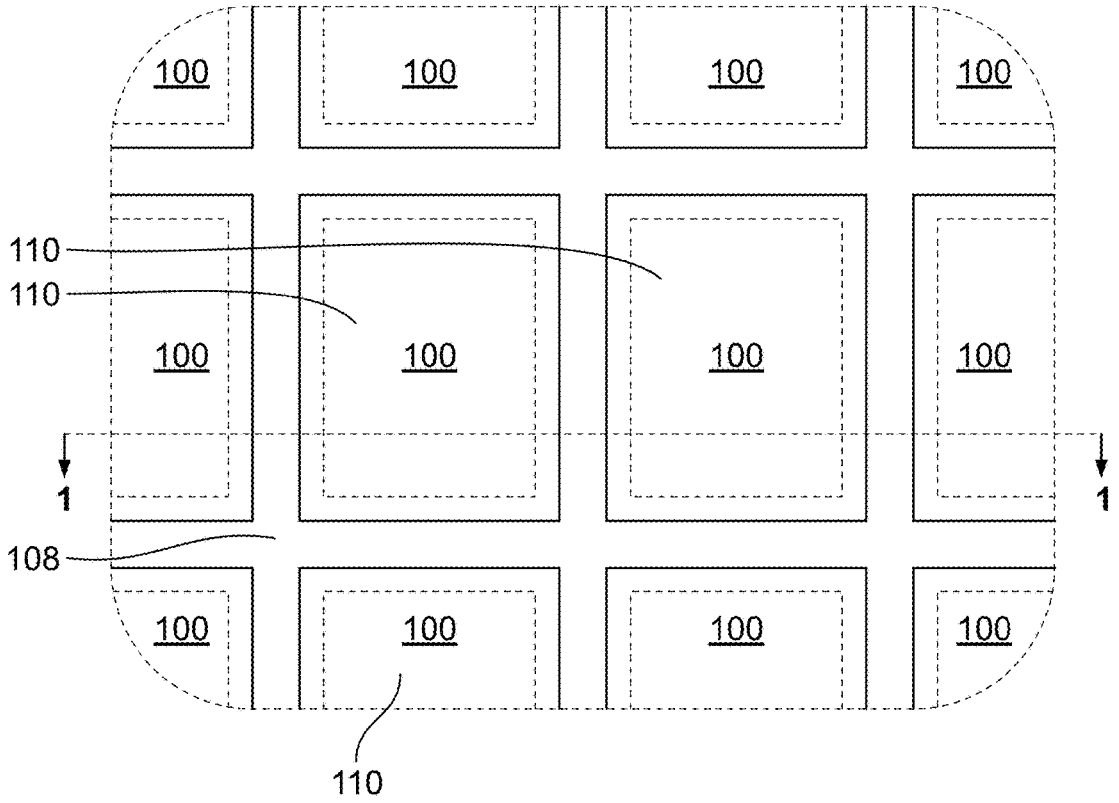
FIG. 2 illustrates a top view of the electrowetting pixels of FIGS. 1A and 1B mostly exposed by an electrowetting fluid, according to various embodiments.

FIG. 1A is a cross-section of a portion of an example reflective electrowetting display device 10 illustrating several electrowetting sub-pixels 100 taken along sectional line 1-1 of FIG. 2. FIG. 1B shows the same cross-sectional view as FIG. 1A in which an electric potential has been applied to one of the electrowetting sub-pixels 100 causing displacement of a first fluid disposed therein, as described below. FIG. 2 shows a top view of electrowetting sub-pixels 100 formed over a bottom support plate 104.

In FIGS. 1A and 1B, two complete electrowetting sub-pixels 100 and two partial electrowetting sub-pixels 100 are illustrated. Electrowetting display device 10 may include any number (usually a very large number, such as thousands or millions) of electrowetting sub-pixels 100. An electrode layer 102 is formed on a bottom support plate 104.

In various embodiments, electrode layer 102 may be connected to any number of transistors, such as thin film transistors (TFTs) (not shown), that are switched to either select or deselect electrowetting sub-pixels 100 using active matrix addressing, for example. A TFT is a particular type of field-effect transistor that includes thin films of an active semiconductor layer as well as a dielectric layer and metallic contacts over a supporting (but non-conducting) substrate, which may be glass or any of a number of other suitable transparent or non-transparent materials, for example.

In some embodiments, a dielectric barrier layer 106 may at least partially separate electrode layer 102 from a hydrophobic layer 107, such as an amorphous fluoropolymer layer for example, also formed on bottom support plate 104. Such separation may, among other things, prevent electrolysis occurring through hydrophobic layer 107. Barrier layer 106 may be formed from various materials including organic/inorganic multilayer stacks or silicon dioxide ($SiO_2$) and polyimide layers. When constructed using a combination of $SiO_2$ and polyimide layers, the $SiO_2$ layer may have a thickness of 200 nanometers and a dielectric constant of 3.9, while the polyimide layer may have a thickness of 105 nanometers and a dielectric constant of 2.9. In some embodiments, hydrophobic layer 107 is an amorphous fluoropolymer layer including any suitable fluoropolymer(s), such as AF1600, produced by DuPont, based in Wilmington, Delaware. Hydrophobic layer 107 may also include suitable materials that affect wettability of an adjacent material, for example.

Sub-pixel walls 108 form a patterned electrowetting pixel grid on hydrophobic layer 107. Sub-pixel walls 108 may comprise a photoresist material such as, for example, epoxy-based negative photoresist SU-8. The patterned electrowetting sub-pixel grid comprises rows and columns that form an array of electrowetting sub-pixels. For example, an electrowetting sub-pixel may have a width and a length in a range of about 50 to 500 micrometers.

A first fluid 110, which may have a thickness (e.g., a depth) in a range of about 1 to 10 micrometers, for example, overlays hydrophobic layer 107. First fluid 110 is partitioned by sub-pixel walls 108 of the patterned electrowetting sub-pixel grid. A second fluid 114, such as an electrolyte solution, overlays first fluid 110 and sub-pixel walls 108 of the patterned electrowetting sub-pixel grid. Second fluid 114 may be electrically conductive and/or polar. For example, second fluid 114 may be, for example, a water solution or a salt solution such as potassium chloride water. First fluid 110 is immiscible with second fluid 114.

A support plate 116 covers second fluid 114 and a spacer 118 to maintain second fluid 114 over the electrowetting sub-pixel array. In one embodiment, spacer 118 extends to support plate 116 and may rest upon a top surface of one or more of the sub-pixel walls 108. In alternative embodiments, spacer 118 does not rest on sub-pixel wall 108 but is substantially aligned with sub-pixel wall 108. This arrangement may allow spacer 118 to come into contact with sub-pixel wall 108 upon a sufficient pressure or force being applied to support plate 116. Multiple spacers 118 may be interspersed throughout the array of sub-pixels 100. Support plate 116 may be made of glass or polymer and may be rigid or flexible, for example. In some embodiments, TFTs are fabricated onto support plate 116.

A driving voltage applied across, among other things, second fluid 114 and electrode layer 102 of individual electrowetting pixels may control transmittance or luminance of the individual electrowetting pixels.

The reflective electrowetting display device 10 has a viewing side 120 on which an image formed by the electrowetting display device 10 may be viewed, and an opposing rear side 122. Support plate 116 faces viewing side 120 and bottom support plate 104 faces rear side 122. The reflective electrowetting display device 10 may be a segmented display type in which the image is built of segments. The segments may be switched simultaneously or separately. Each segment includes one electrowetting sub-pixel 100 or a number of electrowetting sub-pixels 100 that may be adjacent or distant from one another. In some cases, adjacent electrowetting sub-pixels 100 may be sub-pixels 100 that are next to one another with no other intervening sub-pixel 100. In other cases, adjacent electrowetting sub-pixels 100 may be sub-pixels 100 that are located in adjacent pixels. Adjacent sub-pixels 100 may be defined as sub-pixels of the same color that are located in adjacent pixels. Electrowetting sub-pixels 100 included in one segment are switched simultaneously, for example. The electrowetting display device 10 may also be an active matrix driven display type or a passive matrix driven display, for example.

As mentioned above, second fluid 114 is immiscible with first fluid 110. Herein, substances are immiscible with one another if the substances do not substantially form a solution. Second fluid 114 is electrically conductive and/or polar, and may be water or a salt solution such as a solution of potassium chloride in a mixture of water and ethyl alcohol, for example. In certain embodiments, second fluid 114 is transparent, but may be colored or absorbing. First fluid 110 is electrically non-conductive and may for instance be an alkane like hexadecane or (silicone) oil.

Hydrophobic layer 107 is arranged on bottom support plate 104 to create an electrowetting surface area. The hydrophobic character of hydrophobic layer 107 causes first fluid 110 to adhere preferentially to hydrophobic layer 107 because first fluid 110 has a higher wettability with respect to the surface of hydrophobic layer 107 than second fluid 114 in the absence of a voltage. Wettability relates to the relative affinity of a fluid for the surface of a solid. Wettability increases with increasing affinity, and it may be measured by the contact angle formed between the fluid and the solid and measured internal to the fluid of interest. For example, such a contact angle may increase from relative non-wettability of more than 90° to complete wettability at 0°, in which case the fluid tends to form a film on the surface of the solid.

First fluid 110 absorbs light within at least a portion of the optical spectrum. First fluid 110 may be transmissive for light within a portion of the optical spectrum, forming a color filter. For this purpose, the fluid may be colored by addition of pigment particles or dye, for example. Alternatively, first fluid 110 may be black (e.g., absorbing substantially all light within the optical spectrum) or reflecting. Hydrophobic layer 107 may be transparent or reflective. A reflective layer may reflect light within the entire visible spectrum, making the layer appear white, or reflect a portion of light within the visible spectrum, making the layer have a color.

If a driving voltage is applied across an electrowetting sub-pixel 100, electrowetting sub-pixel 100 will enter into an active or open state. Electrostatic forces will move second fluid 114 toward electrode layer 102 within the active sub-pixel as hydrophobic layer 107 formed within the active electrowetting sub-pixel 100 becomes hydrophilic, thereby displacing first fluid 110 from that area of hydrophobic layer 107 to sub-pixel walls 108 surrounding the area of hydrophobic layer 107, to a droplet-like form. Such displacing action uncovers first fluid 110 from the surface of hydrophobic layer 107 of electrowetting sub-pixel 100.

FIG. 1B shows one of electrowetting sub-pixels 100 in an active state. With an electric potential applied to electrode layer 102 underneath the activated electrowetting sub-pixel 100, second fluid 114 is attracted towards electrode layer 102 displacing first fluid 110 within the activated electrowetting sub-pixel 100.

As second fluid 114 moves into the activated electrowetting sub-pixel 100, first fluid 110 is displaced and moves towards a sub-pixel wall 108 of the activated sub-pixel 100. In the example of FIG. 1B, first fluid 110 of sub-pixel 100*a* has formed a droplet as a result of an electric potential being applied to sub-pixel 100*a*. After activation, when the voltage across electrowetting sub-pixel 100*a* is returned to an inactive signal level of zero or a value near to zero, electrowetting sub-pixel 100*a* will return to an inactive or closed state, where first fluid 110 flows back to cover hydrophobic layer 107. In this way, first fluid 110 forms an electrically controllable optical switch in each electrowetting sub-pixel 100.

Figure 3:
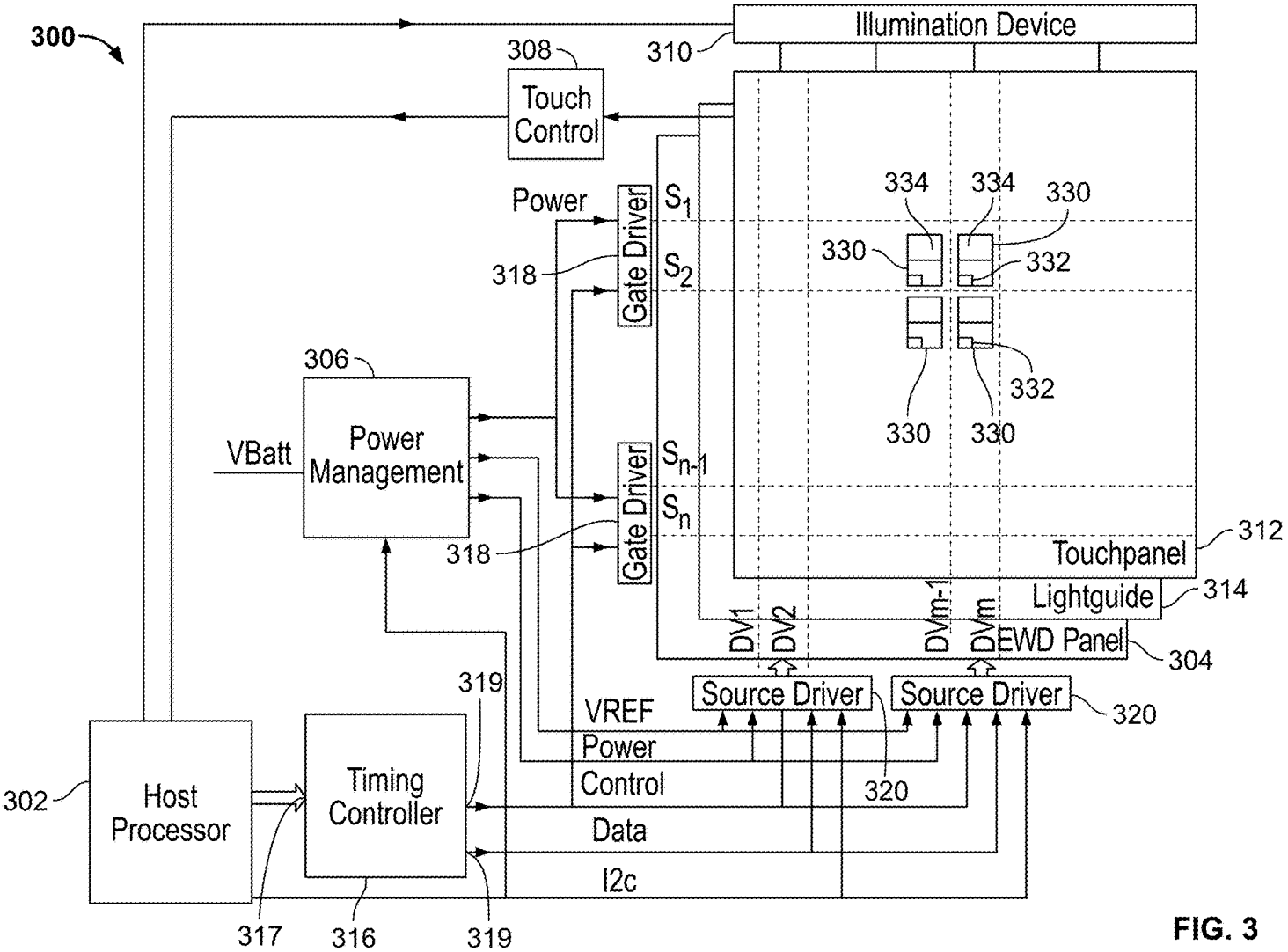
FIG. 3 is a block diagram of an example embodiment of an electrowetting display driving system, including a control system of the electrowetting display device.

FIG. 3 is a block diagram depicting components of an electrowetting display 300. Display 300 includes host processor 302. Host processor 302 executes a host application engine configured to generate image data that is ultimately depicted by display panel 304. Host processor 302 is also configured to communicate with other components of electrowetting display 300, such as power management system, 306 and touch control processor 308 and may receive data from those systems, transmit instructions to those systems to perform specific functions, or update or modify configuration settings of those systems.

Host processor 302 is a microprocessor configured to execute software programs that may include system utilities (e.g., to manage one or more internal system of display 300) and user applications, such as web browsers, video players, electronic readers, and the like. The various applications executed by host processor 302 may each generate output data for display on display panel 304.

In some cases, host processor 302 may also process user inputs provided to display 300 through touch panel 312, which provides a touch-screen interface for a user of display 300. Touch panel 312 may include a capacitive touchscreen surface configured to detect a user touching touch panel 312. The location of such a touch event upon touch panel 312 is detected by touch control processor 308. Touch control processor 308, in turn, transmits the location data associated with the touch event to host processor 302, which can then take appropriate action based upon the detected touch event. For example, the touch may indicate a user input into display 300 that could cause host processor 302 to update a user interface based on the detected touch event. That update then results in host processor 302 generating new output image data.

In some cases, to facilitate viewing by a user, display panel 304 may require additional illumination beyond that provided by ambient light sources. Accordingly, an illumination device 310 can be coupled to display 300 and configured to illuminate at least a portion of display panel 304 and the pixels therein. If display panel 304 is implemented as an array of transmissive pixels, the illumination device 310 may be implemented as a back light. In which case, when activated, the illumination device 310 causes light to pass through the open pixels of the display panel 304 to a viewer. Conversely, if the display panel 304 is implemented as an array of reflective pixels, the illumination device 310 may be implemented as a front light. In which case, when activated, the illumination device 310 causes light to strike the viewing surface of the display panel 304 and be reflected back out of open pixels to a viewer. The front light configuration of illumination device 310 may be coupled to a lightguide sheet 314 to distribute light over display panel 304. Lightguide sheet 314 may include a substrate (e.g., a transparent thermoplastic such as PMMA or other acrylic), a layer of lacquer and multiple grating elements formed in the layer of lacquer that functions to propagate light from illumination device 310 to display panel 304.

The illumination device 310 may be implemented using any appropriate light generating devices, such as an LED or an array of LEDs. The illumination device 310 may include a single or multiple light sources disposed at one or more edges of display panel 304, or, when implemented as a backlight, may include a number of different light sources distributed over a back surface of display panel 304.

Host processor 302 is coupled to illumination device 310 enabling host processor 302 to control an output of illumination device 310 and, specifically, a magnitude of light generated by illumination device 310. In one specific embodiment, for example, illumination device 310 is driven by a pulse-width modulated (PWM) power supply. In that case, host processor 302 may control the output of the illumination device 310 by adjusting or controlling the duty cycle of the PWM power supply that powers illumination device 310.

Power management system 306 manages a supply of electrical energy to the various components of display 300. Power management system 306 may be configured to modify the operation of those various components in order to minimize or reduce power consumption by those components. For example, if specific functions within display 300 are not being utilized (e.g., if a wireless networking operations are turned off), power management system 306 can turn off the power supply to components within display 300 responsible for those specific functions. Similarly, if touch-screen functionality is not required, power management system 306 may turn off the power supply to touch control processor 308.

Power management system 306 is also configured to supply electrical energy to display panel 304. Display panel 304 includes a number of electrowetting pixels that, when subject to an electrical driving voltage, can modify their state (i.e., their luminance) in order to depict images in display panel 304. In one embodiment, display panel 304 includes an array of 768 square pixels per row (each including red, green, blue, and white sub-pixels) and 1024 rows of pixels. The sub-pixels in display panel 304 may be addressed one row at a time and the driving voltages of each sub-pixels may be set at a resolution of 63 levels, enabling each sub-pixel to depict 63 difference levels of luminance. The rows of sub-pixels can, in one embodiment, be addressed in an interlaced fashion, which may improve perceived picture quality of display panel 304.

The pixels of display panel 304 are generally arranged in a number of rows and columns of pixels. In the embodiment of FIG. 3, each pixel includes a sub-pixel configured to either reflect or transmit red, blue, green, or white light. By modulating the driving voltages being applied to each sub-pixel in a particular pixel, a pixel in display panel 304 can be configured to either transmit or reflect light of a particular color that is the result of the combination of light reflected or transmitted by each of the individual red, green, blue, and white sub-pixels.

In order to depict information via display panel 304, the output image data generated by host processor 302 is ultimately translated into driving voltage values that are configured to set the luminance state of the electrowetting pixels of display panel 304 in a manner suitable for displaying information based on that output image data.

In one implementation of display device 300, the image data generated by host processor 302 is generally in the form of a number red, green, blue (e.g., RGB) values that specify a desired output color for each pixel in display panel 304. But because each pixel in display panel 304 includes a red, green, blue, and white sub-pixel, before the RGB data can be used to control the individual sub-pixels in display panel 304, the RGB data must first be converted into RGBW data that is in the RGBW color space. The RGBW data includes specific luminance values for each of the red, green, blue, and white sub-pixels in the pixels of display panel 304. With the sub-pixels of a particular pixel set to driving voltages based on the luminance values determined by the RGBW values, the sub-pixels will be configured to reflect or transmit light having a color that approximates the color specified by the original RGB value.

Figure 4:
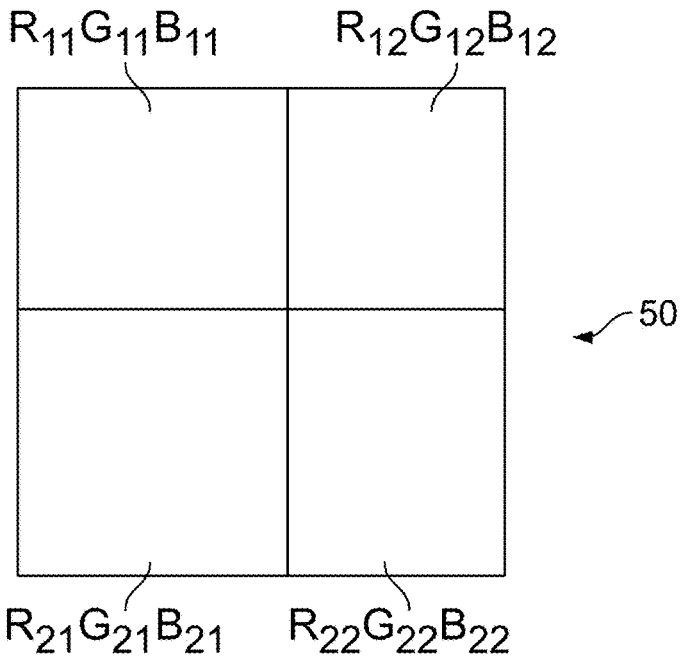
FIG. 4 depicts the translation of RGB source image data into RGBW data for display on a PENTILE display panel.
Figure 4:
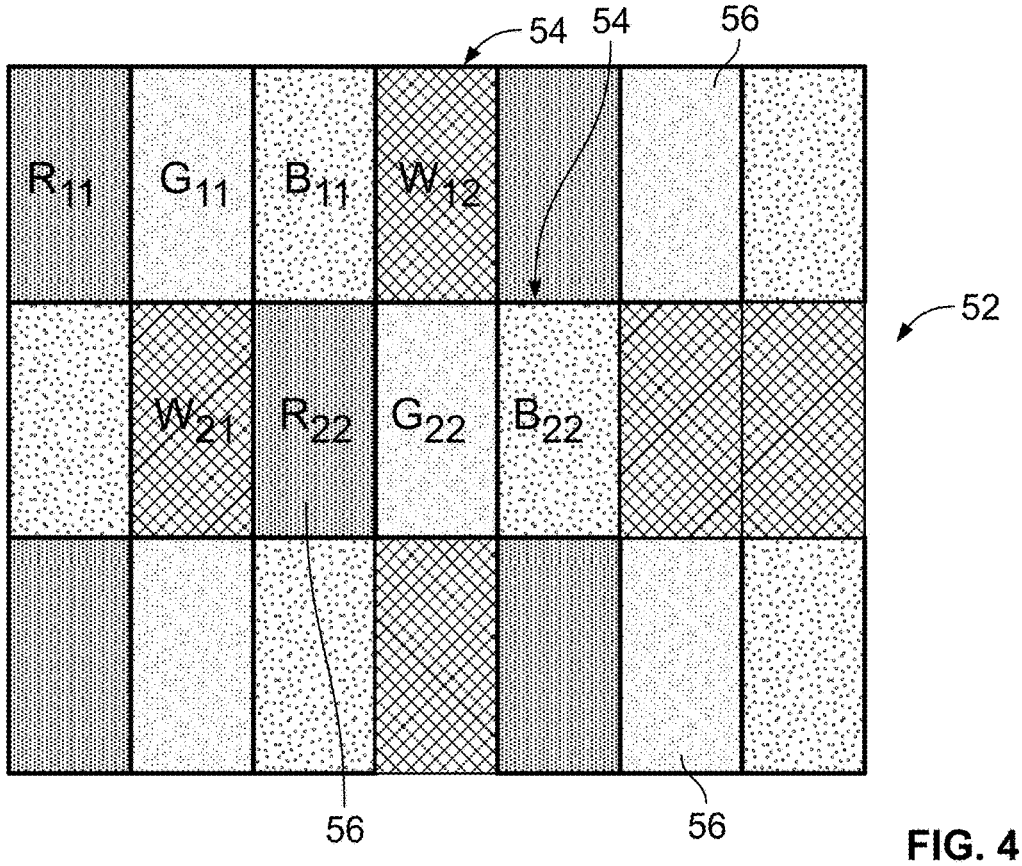

To illustrate, FIG. 4 depicts the translation of RGB source image data into RGBW data that specifies luminance values for each sub-pixel in an RGBW pixel. In this example, source image data 50 (i.e., the data being generated by host processor 302 and being passed into timing controller 315) specifies image data for four source image pixels (in a real-world example, the source image data would include data for many more image pixels). The source image pixels each have a location within a source image as defined by the coordinates associated with each source image pixel. A single RGB value is specified for each pixel within image data 50, where each RGB value describes a particular color. Timing controller 316 receives source image data 50 from host processor 302 and maps each source image pixel within image data 50 to a particular pixel or combination of pixel (sometimes referred to as a "pixel pair") in the pixel array 52 of the display panel (e.g., display panel 304), where each pixel includes a group of sub-pixels. In this example, each pixel 54 in pixel array 52 includes a red, green, blue, and white sub-pixel 56. The display device then translates the RGB value for a particular pixel in source image data 50 into luminance values for each sub-pixel 56 in the corresponding pixel 54 of pixel array 52. When the sub-pixels 56 in the corresponding pixel 54 are set to those luminance values (e.g., by being subjected to a particular driving voltage based on or derived from the luminance values by the combination of source drivers 320 and gate drivers 328), an observer's eye combines the outputs of the various sub-pixels 56 into the corresponding color specified in the source image data 50.

The pixel configuration depicted by pixel array 52 is, in one example, a PENTILE structure. In such an arrangement, the groups of sub-pixels are arranged in a square pixel grid at a physical pitch, with each sub-pixel covering an area representing a primary color at a defined brightness. The arrangement, as illustrated in FIG. 4 exhibits a 45 degree diagonal symmetry, for example.

Returning to FIG. 3, in order to perform the translation of the RGB image data generated by host processor 302, host processor 302 passes the output image data, which includes only RGB data, to timing controller 316. As described below, timing controller 316 is configured to convert the image data received from host processor 302 into a format (e.g., RGBW luminance data) that can be used to set the driving voltages for each of the sub-pixels of display panel 304 to appropriate driving voltage levels.

Specifically, timing controller 316 converts the input RGB data into RGBW data. Using the RGBW data, timing controller 316 uses gate drivers 318 (e.g., row drivers) and source drivers 320 (e.g., column drivers) to subject the sub-pixels in display panel 304 to appropriate driving voltages based upon those RGBW values. The gate drivers 318 and source drivers 320 may be referred to as display drivers. This generally involves timing controller 316, responsive to image data received from host processor 302, applying a data signal and a control signal to the source drivers 320 in combination with a second control signal to the gate drivers 318.

The source driver 320 converts the data signal to voltages, i.e., driving voltages, and applies the resulting driving voltages DV1, DV2, . . . , DVm-1, and DVm to the electrowetting display panel 304. The gate drivers 318 sequentially applies scan signals S1, S2, . . . , Sn-1, and Sn to the electrowetting display panel 304 in response to the third control signal.

The sub-pixels 330 of display panel 304 are positioned adjacent to crossing points of the data lines and the gate lines and thus are arranged in a grid of rows and columns. Each sub-pixel 330 includes a hydrophobic surface, and a thin film transistor (TFT) 332 and a pixel electrode 334 under the hydrophobic surface. Each sub-pixel 330 may also include a storage capacitor (not illustrated) under the hydrophobic surface.

Display panel 304 includes m data lines D, i.e., source lines, to transmit the data voltages and n gate lines S, i.e., scan lines, to transmit a gate-on signal to the TFTs 332 to control the sub-pixels 330. Thus, the timing controller 316 controls the source drivers 320 and gate drivers 318 to apply particular driving voltages to the sub-pixels 330 of display panel 304. Specifically, gate drivers 318 sequentially apply the scan signals S1, S2, . . . , Sn-1, and Sn to the display panel 304 in response to control signal being supplied to gate drivers 318 by timing controller 316 to activate rows of sub-pixels 330 via the gates of the TFTs 332. Source drivers 320 then applies the driving voltages DV1, DV2, DVm-1, and DVm to the sources of the TFTs 332 of the sub-pixels 330 within an activated row of sub-pixels 330 to thereby activate (or leave inactive) sub-pixels 330.

Timing controller 316 is generally implemented as an application-specific integrated circuit with a single package or integrated circuit (IC) chip. In an embodiment, timing controller 316 may be implemented as a wafer-level chip scale package in which the package includes a single semiconductor die that incorporate the entire functionality of timing controller 316. This is in contrast to other device packages that may include a number of separate but interconnected semiconductor die.

In such a configuration, the packaged integrated circuit implementing timing controller 316 can be affixed to a substrate and interconnected with other components of display 300 to put timing controller 316 is electrical communication with those other components. To facilitate such interconnection, timing controller 316 can include one or more input pins 317 and output pins 319. Input pins 317 and output pins 319 are connected to the internal circuits of timing controller 316 and, because input pins 317 and output pins 319 can be connected to external components, can put those external components into electrical communication with the internal circuits of timing controller 316.

For example, with reference to FIG. 3, input pins 317 may be input signal pins that are electrically connected to host processor 302 for the receipt of image data from host processor 302. If both timing controller 316 and host processor 302 are mounted to a substrate (such as a printed circuit board (PCB), this may involve connecting an input pin 317 of timing controller 316 to a conductive trace formed over the substrate, where the trace is, in turn, connected to host processor 302. In such an embodiment, the trace may include a metal or other conductive material that is plated, printed, or otherwise deposited or formed over a surface of the substrate to which both timing controller 316 and host processor 302 are mounted. The input pins 317 of timing controller 316 can be connected to the trace using any suitable technique including the deposition of conductive solder or the formation of wire bonds between the input pin 317 and the corresponding trace.

Input pins 317 are physical structures and may be configured to receive electrical energy (e.g., from power management system 306) for powering one or more of the circuits within timing controller 316. Alternatively, one or more input pins 317 of timing controller 316 may be configured to receive data signals from various components of display 300, such as image data from host processor 302, image processing parameters from host processor 302, settings from host processor 302, and the like.

Timing controller 316 also includes a number of output pins 319, which may be output signal pins. Output pins 319 enable timing controller 316 to generate output signals that are communicated to other components of display 300. For example, output pins 319 are electrically connected to gate drivers 318 and source drivers 320. This enables timing controller 316, through output pins 319, to transmit data to one or more of gate drivers 318 and source drivers 320 that cause the gate drivers 318 and source drivers 320 to subject the sub-pixels 330 of display 300 to particular driving voltages, enabling display panel 304 to generate output images based on the image data generated by host processor 302 and subsequently processed by timing controller 316.

Output pins 319 may be electrically connected to traces that are, in turn connected to gate drivers 318 and source drivers 320. In that case, output pins 319 of timing controller 316 could be connected to such a trace using any suitable technique including the deposition of conductive solder or the formation of wire bonds between the output pins 319 and the corresponding trace.

In the configuration depicted in FIG. 3, timing controller 316 is implemented in a single package that be mounted to a suitable structure and electrically connected to other components of display 300 using input pins 317 and output pins 319. Timing controller 316, therefore, represents a single component that can translate the output of host processor 302, which is image data in a typical RGB format suitable for conventional display technologies, into a format suitable for electrowetting displays and, specifically, PENTILE-configured electrowetting displays. Timing controller 316 can also generate outputs that are suitable for supplying through pins 319 directly to gate drivers 318 and source drivers 320. As such, the self-contained configuration of timing controller 316 may require fewer components than a conventional implementation approach that may include many different individual separate components to implement the functionality of timing controller 316 and, consequently, require the mounting of those many different components to a substrate and then electrical interconnection of those components.

Figure 5:
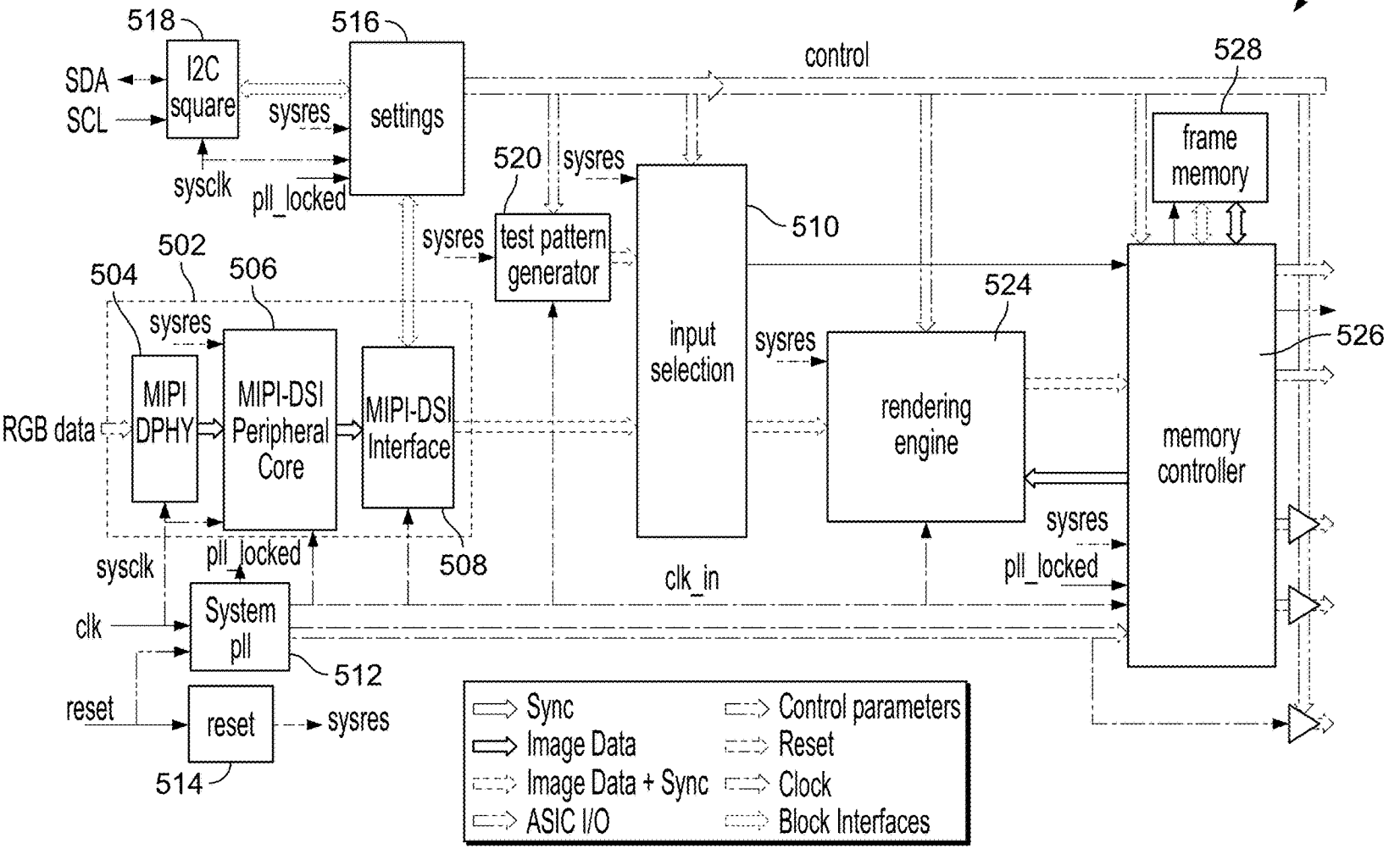
FIG. 5 is a block diagram depicting functional components of the timing controller of FIG. 4.

FIG. 5 is a block diagram depicting functional components of timing controller 316 of FIG. 4. Timing controller 316 may be implemented as an application-specific integrated circuit, in which case the functional blocks depicted in FIG. 5 may be implemented as integrated circuits that are part of the same semiconductor die and/or are integrated into a packaged integrated circuit.

Timing controller 316 includes an input interface 502 configured to receive input image data (such as the RGB image data generated by host processor 302 of FIG. 3). Input interface 502 may be implemented as a serial data interface including a number of input and output buffers. As depicted in FIG. 5, input interface 502 can be a Mobile Industry Processor Interface physical (MIPI D-PHY) interface. Input interface 502 includes a first input buffer 504 (e.g., a MIPI DPHY input buffer) configured to receive the RGB image data from host processor 302. Peripheral core 506 retrieves the image data from input buffer 504 and repackages the image data in a DSI format. Finally MIPI-DSI interface 508 retrieves the DSI-encoded image data from peripheral core 506 and transmits that data, in combination with frame synchronization data to input selection block 510.

During the operation of timing controller 316, peripheral core 506 receives a clock signal from an ASIC system phase locked loop (PLL) 512. The PLL timing signals generated by PLL 512 may be based upon the receipt of an external clock signal (CLK) which may determine the frequency of operation of PLL 512 and the frequency of the PLL signal being outputted by PLL 512. The external clock signal CLK may be generated by an external clock component. As depicted in FIG. 5, the PLL timing signal generated by PLL 512 is also supplied to a number of other components within timing controller 316 and, consequently, may be used by those other components to control their own frequency of operation so that their operations are synchronized according to the clock signal CLK.

Input interface 502 can receive data from host processor 302 using a number of independent channels (e.g., 2 or 4 channels) and in different data transfer modes (e.g., streaming video modes or command modes). In one embodiment, input interface 502 has a minimum bandwidth of approximately 1.2 megabits per second (Mb/s). Such an implementation may require that input interface 502 be implemented as a 4 channel MIPI interface operating at 150 MHz or a 2 channel MIPI interface operating at 300 MHz. In some cases, to potentially save power at this interface, image data can be transferred in burst mode.

Timing controller 316 may also receive a reset signal (reset), which is supplied as an input to reset block 514. Upon receipt of the reset signal, reset block 514 generates an output system reset (sysres) signal that is, in turn, supplied as an input to a number of the functional blocks of timing controller 316. The sysres signal can be used to reset or initialize the various components of timing controller 316 to an initial set state. This may occur, for example, when display 300 is first powered-up or turned on.

When processing image data received via input interface 502 and generating output signals to both gate drivers 318 and source drivers 320 (see FIG. 3), the operations of timing controller 316 may be at least partially governed by a number of settings or image processing parameters. These settings can be stored in settings register 516. In one embodiment, settings register 516 stores the settings as 8-bit parameters in 16 bit addressable registers, which can be written and read via a serial control interface. The settings may be used to control the operating parameters of any of the components of timing controller 316. The settings may, for example, specify operating voltage levels and frequencies for one or more of the components in timing controller 316, parameters to be used in image data processing, such as gamma correction levels, filter parameters, display panel pixel configuration, and the like.

The settings stored in settings register 516 may be provided through a serial interface, such as I2C interface 518. I2C interface 518 can be used to read and write registers into settings register 516. Alternatively, if the I2C interface 518 is unavailable (in some cases I2C interface 518 may only be fully implemented in testing configurations of timing controller 316), input interface 502 may instead be used by external components, such as host processor 302, to insert or update settings contained within I2C interface 518.

After settings have been stored in settings register 516, those settings can be retrieved (or transmitted to) other components of timing controller 316. As shown in FIG. 5, settings register 516 is connected to test pattern generator 520, input selection 510, rendering engine 524 and memory controller 526 enabling those components to retrieve settings, such as image processing parameters, as needed. Additional components of timing controller 315 may be connected to settings register 516 to receive settings therefrom.

To facilitate testing, timing controller can include test pattern generator 520. Test pattern generator 520 stores one or more frames of pre-determined test image data. The test image data can be used to drive the various sub-pixels 330 of display panel 304 (see FIG. 3) through a set of target luminance levels. While the sub-pixels 330 are being driven using the test data, the state of the sub-pixels 330 can be monitored using external testing equipment to ensure that the various sub-pixels 330 of display panel 304 are operating properly in accordance with the test image data. If, for example, several sub-pixels 330 are determined to be non-responsive to the test image data (i.e., the sub-pixels 330 do not change their luminance values in a predetermined manner in response to the test image data), those sub-pixels 330 may be determined to be defective. If a sufficiently large number of sub-pixels 330 are determined to be defective within a display panel 304, the entire display panel 304 may be determined to be defective. Accordingly, the testing data stored in test pattern generator 520 can be used to test the operation of a connected display panel 304, such as during fabrication of display device 300.

Test pattern generator 520 is connected to input selection 510. Input selection 510 includes two separate inputs, each configured to receive image data. The first input of input selection 510 is connected to test pattern generator 520 and is configured to receive the test image data outputted by test pattern generator 520. The second input of input selection 510 is connected to input interface 502 and is configured to receive image data from external components, such as host processor 302, via input interface 502.

During normal operations, in which test pattern generator 520 is non-operative and does not transmit an output signal, input selection 510 receives input image data from input interface 502 and passes that image data along to rendering engine 524 for processing, where the data is ultimately used to render images on display panel 304. During testing, however, test pattern generator 520 is enabled causing test pattern generator 520 to output image data to the first input of input selection 510. Test pattern generator 520 may be enabled upon receipt of setting data from settings register 516 instructing test pattern generator 520 to output the test image data. Similarly, setting data stored in settings register 516 is communicated to input selection 510, causing input selection 510 to receive and pass only the test image data to rendering engine 524, causing the test image data to be display on display panel 304.

Rendering engine 524 is configured to receive input image data from either input interface 502 or test pattern generator 520. Generally, that input image data is configured as RGB data. Because each pixel of display panel 304 includes a red, green, blue, and white sub-pixel, that input image data is converted into target luminance values for each of the red, green, blue, and white sub-pixels. Those target luminance values are then communicated into the gate drivers 318 and source drivers 320, where the target luminance values are ultimately converted into driving voltages that are communicated into the sub-pixels to set their respective luminance values.

After the input RGB image data has been converted into RGBW luminance values by rendering engine 524, those values are transmitted to memory controller 526 for storage within frame memory 528. When a frame of data is to be transmitted to display panel 304, memory controller 526 retrieves the current RGBW values for the current frame and transmits those values to gate drivers 318 and source drivers 320 for conversion into corresponding driving voltages that are ultimately transmitted to the sub-pixels of display panel 304.

Rendering engine 524 is generally implemented as a sequence of functional blocks, where each block is implemented within an integrated circuit of timing controller 316. Each functional block of rendering engine 524 is configured to perform one or more transformations of the input image data in order to generate output image data that includes target luminance values for the sub-pixels of display panel 304.

Figure 6:
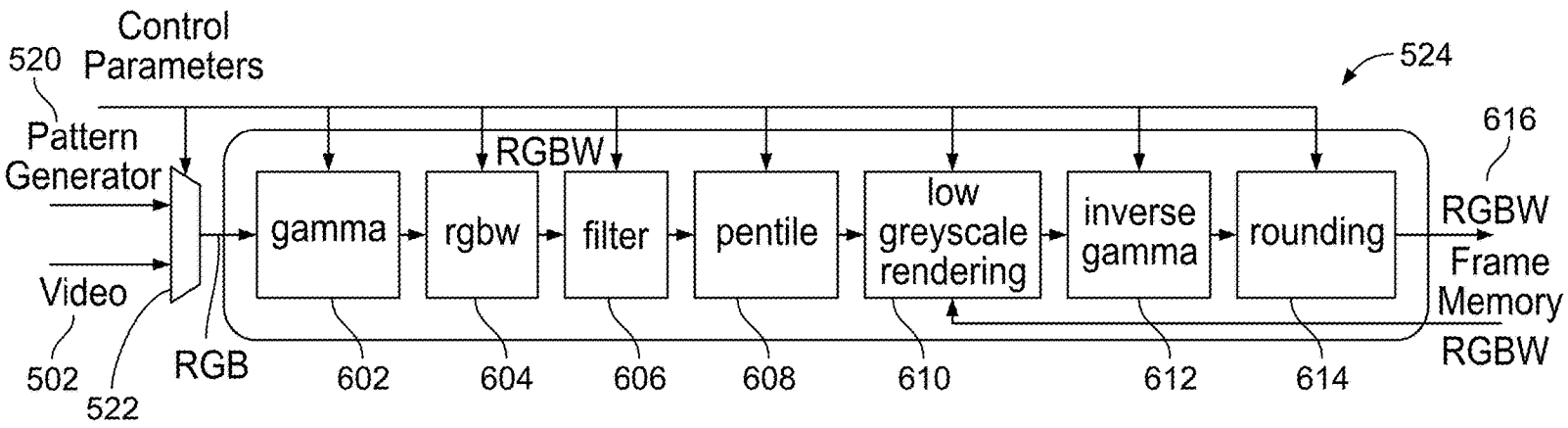
FIG. 6 is a block diagram depicting the functional elements of the rendering engine of the timing controller of FIG. 5.

FIG. 6 is a block diagram depicting the functional elements or blocks of rendering engine 524. As shown, rendering engine 524 receives input image data in the form of RGB values from either test pattern generator 520 or input interface 502 through input selection 510.

During operation of rendering engine 524, the RGB input image data is received in the form of streaming video data provided by test pattern generator 520 or input interface 502. The input image data may be compliant with the sRGB standard and, as such, the input image data includes RGB video values, usually specified as a hexadecimal number, for each pixel position in the input image data. The RGB video values for each pixel generally represents a specific hue, saturation and brightness, corresponding to the sRGB standard primary colors and relative intensities.

As described in more detail below, rendering engine 524 may be configured to process the input image data containing RGB video data in a number of different modes. For example, in some cases the input image data may be at least partially processed by an external component (e.g., host processor 302) of device 300. For example, in one operational mode, the input image data may be pre-rendered and contain red, green, blue, and white video values. In that case, the functional blocks of rendering engine 524 that are used to convert RGB input image data into RGBW values may be rendered inactive. In such an operational mode, the external component (e.g., host processor 302) implements in software some of the functional elements of rendering engine 524, such as gamma block 602, RGBW block 604, and the like. If those functions have already been implemented in software, they can be bypassed within rendering engine 524 when rendering engine 524 processes the pre-processed image data.

In that case, even though some of the functional blocks of rendering engine 524 may be bypassed, some of the functional blocks that process the image data in a manner that depends on the specific configuration and properties of display panel 304 may continue to be executed. Such a function, for example, includes PENTILE block 608, which adjusts the RGBW image data inputted into PENTILE block 608 to take into consideration the specific PENTILE layout of the sub-pixels in display panel 304.

The output 616 of rendering engine 524 includes RGBW luminance values for each pixel position (sometimes referred to as a pixel pair), aligned within the PENTILE layout of display panel 304. These should correspond as much as possible to the source image definition, and hence can be optimized for the properties of display panel 304.

Within rendering engine 524, the operation of the functional blocks can be at least partially controlled by programmable parameter or image processing settings retrieved from settings register 516. The settings may allow the functional blocks to be able to adapt to user preferences or specific properties of display panel 304 (e.g., contrast, brightness, color, electro-optical transmission, response time, and the like), application specific requirements (e.g. power consumption, frame rate performance, and the like), as well as ambient conditions (e.g. ambient light, temperature, and the like).

Within rendering engine 524, gamma block 602 is configured to receive the input RGB image data. The input RGB image data specifies colors in the video domain. In the video domain, the RGB values specify colors that are suitable for rendering within the perceptual domain. That is, the color values are suited for the human eye, rather than processing within a display device.

Before those values can be processed for display panel 304, however, the RGB values must be converted into the luminance domain. After conversion to the luminance domain, the converted RGB values represent a target luminance of typical red, green, and blue sub-pixels in an electrowetting display to achieve the color specified by the video domain RGB value.

Generally, gamma block 602 may be implemented using a look-up table specifying, for particular RGB input video values, a corresponding luminance value. The look-up table may store, for every possible RGB input video value, corresponding luminance values. Such a look-up table can, in some respects, be relatively large and so in some embodiments gamma block 602 may utilize alternative look-up table configurations.

For example, the look-up table may only store luminance conversion values for a subset of possible RGB input video values. If an input RGB video value is not contained within the subset of RGB values, a luminance value can be determined by interpolating between the available RGB values and corresponding luminance values.

One of the control parameters received by gamma block 602 from settings register 516 may include a setting that controls whether the logic of gamma block 602 is enabled. If enabled, gamma block 602 operates to perform gamma correction on input RGB video data to convert that data into the luminance domain. If, however, gamma block 602 is not enabled, gamma block 602 may pass the input RGB data straight through to an output without modifying the RGB data. This may be a useful mode of operation, for example, if another external component (e.g., host processor 302) has already performed gamma correction on the RGB data before passing that data into gamma block 602.

RGBW block 604 is configured to receive the RGB luminance data from gamma block 602 and convert the RGB luminance values into RGBW luminance values. The conversion from RGB video data to RGBW luminance values requires color space morphing, from RGB data (constructed according to the sRGB video standard) to an RGBW color space that includes vales for the white sub-pixels of display panel 304.

The input data to RGBW block 604 includes the red luminance values, green luminance values, and blue luminance value (i.e., RGB luminance values) generated by gamma block 602. By mixing these three primary colors, a range of hue, saturation and intensities can be reproduced. But display panel 304 uses pixels that each include RGB and W sub-pixels to represent a range of hue, saturation and intensities. RGBW block 604, therefore, converts the RGB input values into RGBW output luminance values with related hue, saturation and intensity. For less saturated input colors, the RGB brightness is typically the same its related W brightness, yet the hue and saturation can only be preserved by the RGB values.

Figure 7A:
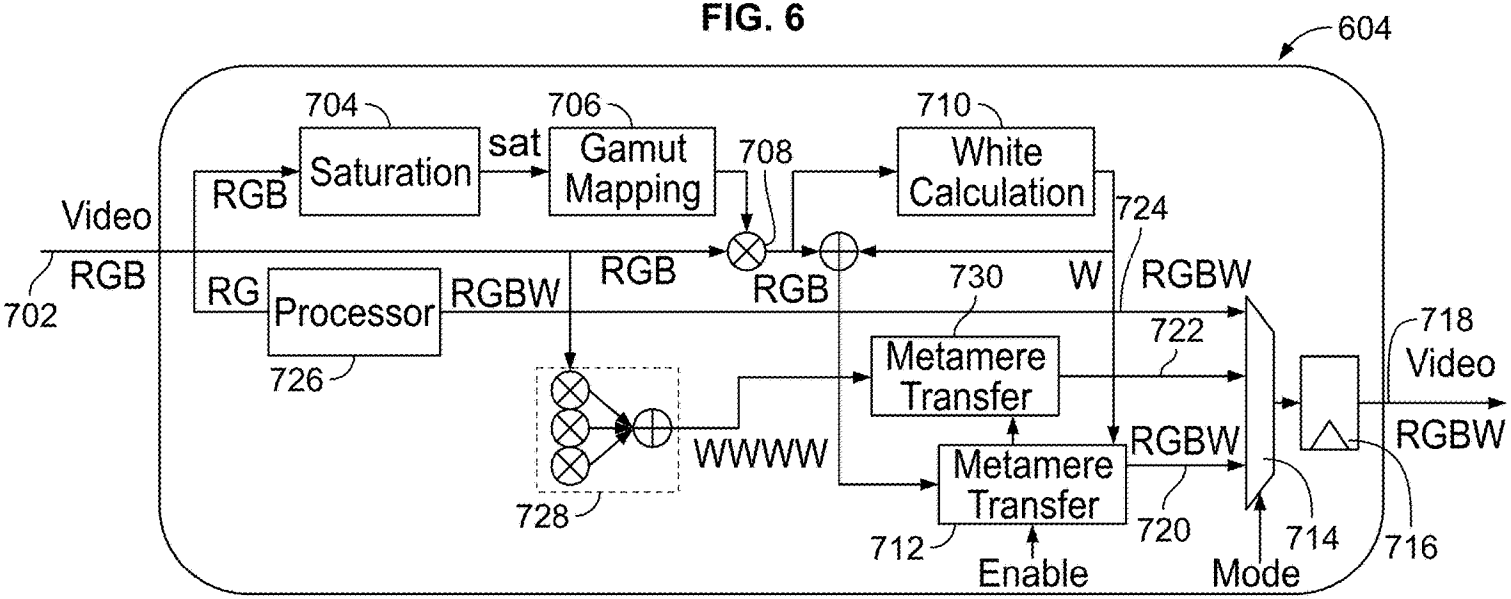
FIG. 7A is a logical block diagram depicting the process the RGBW block of the rendering engine of FIG. 6 uses to transform input RGB image data into output RGBW image data.

FIG. 7A is a logical block diagram depicting the process RGBW block 604 uses to transform input RGB image data into output RGBW image data. RGBW block 604 receives RGB input data at input 702. Because the color space transformation can be affected by the degree to which the input RGB image data indicates that the corresponding pixel is saturated, the RGB input data is provided to saturation block 704. Saturation block 704 determines a degree to which a color in the RGB input data is saturated and outputs a value describing that degree of saturation. For each color in the RGB input data, the saturation of that color can be determined by comparing the difference between the luminance value for that color to the luminance values of the other colors in the RGB data. The greater the difference, the more saturated the color. The value of saturation can be a numeric value determined, for example, by subtracting a lowest luminance value for each of the RGB luminance values from the luminance value for the color being analyzed. That numerical difference can then be set to the saturation value for that color. Alternatively, the saturation of a particular color may be a value calculated as the ratio the lowest luminance value in each of the RGB luminance values to the luminance value for the color being analyzed. In some cases, to normalize the saturation value, that ratio may be subtracted from 1 so that colors with a saturation value of 1 are fully saturated, which colors with a saturation value of 0 are not saturated. The RGB input data is passed to color gamut mapping block 706. Color gamut mapping block 706 is configured to calculate offsets for each of the red, green, and blue image data values that, when added to the input red, green, and blue image luminance values will morph the input RGB data in the RGBW color space. That is, the RGB input values will be converted into red, green, and blue values suitable for combining with a white value (calculated elsewhere) to form RGBW luminance data.

The offset calculated by color gamut mapping block 706 could be determined by a look-up table that can provide one or more transfer functions specify particular offset values based upon the level of saturation received from saturation block 704.

The following are example transfer functions that color gamut mapping block 706 may use to calculate an offset to apply to each of the RGB input values in order to morph those input values into the RGBW color space:

Offset=1/(1+saturation) (the value saturation is calculated and outputted by saturation block 704)

Offset=1−(0.5*saturation)

Offset=1/(1+saturation^2)

Offset=1−(0.5* saturation^2)

With the offset calculated by color gamut mapping block 706, the offsets are added to each of the red, green, and blue values in the input RGB data at combiner node 708. The output of combiner node 708, which includes RGB values that have been morphed into the RGBW color space (and so, these are color gamut-mapped RGB values), is then supplied to white calculation block 710, which calculates a target level for a corresponding white sub-pixel using the morphed RGB values received from node 708.

Figure 7B:
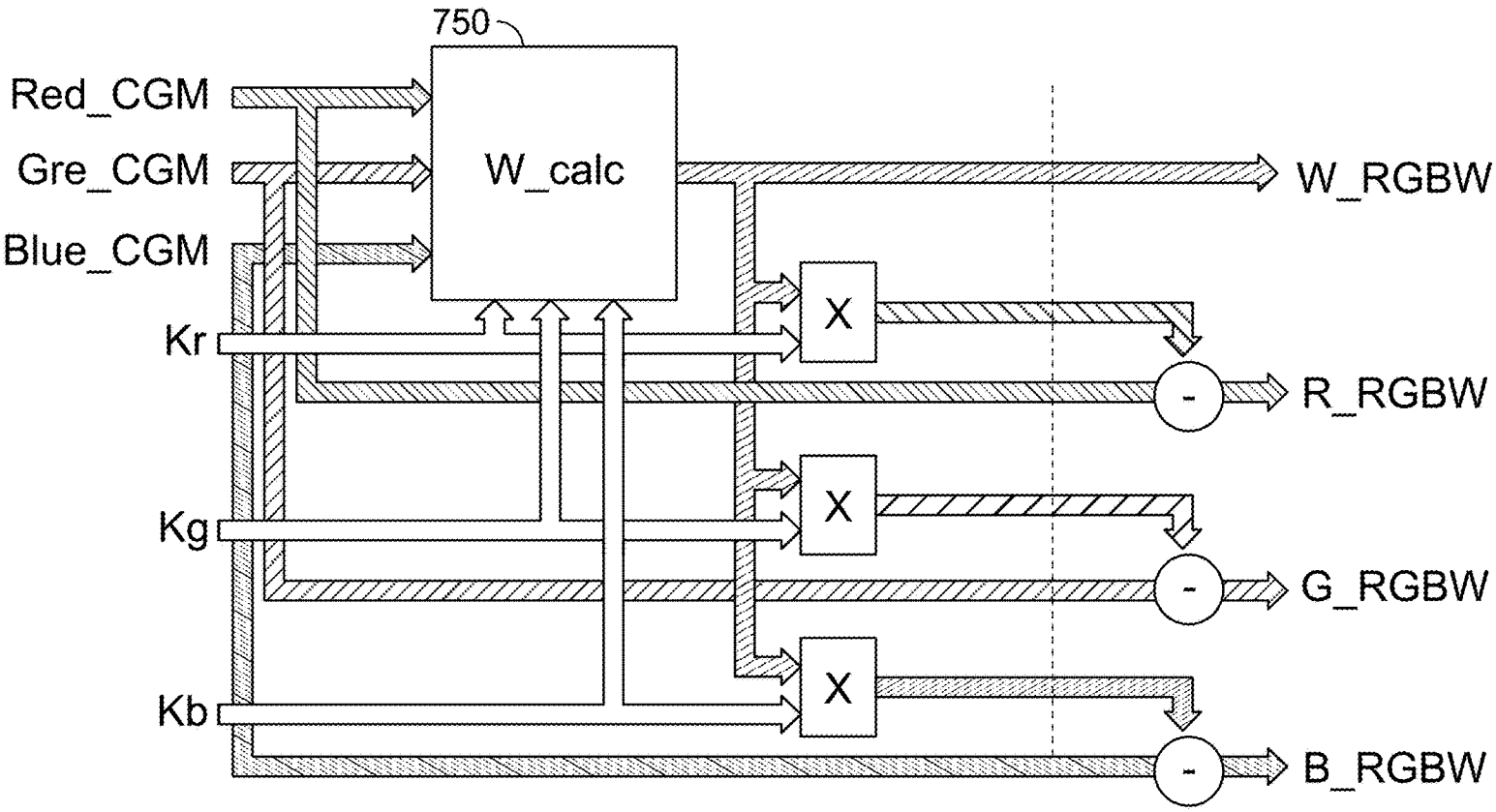
FIG. 7B is a logical block diagram illustrating the process for calculating a level for a white sub-pixel using color gamut mapped input RGB values.

FIG. 7B is a logical block diagram illustrating the process for calculating a level for a white sub-pixel using color gamut mapped input RGB values. Accordingly, FIG. 7B depicts the algorithm implemented by white calculation block 710. As illustrated, the inputs to the algorithm are the RGB color gamut mapped values outputted by node 708 (see FIG. 7A). W_calc block 750 calculates an optimal luminance for a corresponding white sub-pixel based upon the input RGB color gamut mapped values (Red_CGM, Gre_CGM, and Blue_CGM). The determination of the optimal white sub-pixel luminance (WOPT) is constrained by minimum and maximum white sub-pixel luminance values (WIN and WMAX, respectively). The values WMIN and WMAX can be used to constrain allowable luminance values for the display's white sub-pixels and so can set a target white point for the display. As such, the values WMIN and WMAX set a target white point within the color space of the display device. The calculation of WOPT may rely upon a number of parameters (kr, kg, and kb) that may be used to tune the white-point of display panel 304 by changing the color appearance of unsaturated colors.

In an embodiment, the WMAX value used by W_calc block 750 is determined by:

$$\text{WMAX}=\text{MIN}\ (\text{Red_CGM}/(1+Kr),\ \text{Green_CGM}/(1+Kg),\ \text{Blue_CGM}/(1+Kb))$$

In an embodiment, the WMIN value used by W_calc block 750 is determined by:

$$\text{WMIN}=\text{MAX}\ ((\text{Red_CGM}-1)/(1+Kr),\ (\text{Green_CGM}-1)/(1+Kg),\ (\text{Blue_CGM}-1)/(1+Kb)))$$

In an embodiment, the value WOPT is calculated using the following equation. The value of WOPT is clipped between the values WMIN and WMAX so that if the below equation generates a WOPT value that is less than WMIN, WOPT is set to WMIN and similarly if the below equation generates a WOPT value that is greater than WMAX, WOPT is set to WMAX.

$$\text{WOPT}=0.25*\text{Red_CGM}+0.675*\text{Green_CGM}+0.125*\text{Blue_CGM}$$

With the value WOPT calculated, the color gamut mapped RGB luminance values are reduced by some amount. The reason for this is that the color gamut mapped RGB values do not take into account that each pixel in display panel 304 also includes a white sub-pixel that will be set to a luminance of WOPT. If the color gamut mapped RGB were not reduced by some amount, with the addition of a white sub-pixel set to a value of WOPT, the overall pixel luminance or brightness would be too great. Accordingly, this requires a reduction in the luminance of the red, green, and blue sub-pixels in compensation for the white sub-pixel having a luminance of WOPT. Accordingly, the color gamut mapped RGB values, having been used to calculate WOPT, can be reduced according to the following equations:

$$R_RGBW = Red_CGM - (1+Kr)*WOPT)$$

$$G_RGBW = Green_CGM - (1+Kg)*WOPT)$$

$$B_RGBW = Blue_CGM - (1+Kb)*WOPT)$$

The resulting RGBW luminance values has the red value R_RGBW, the green value G_RGBW, the blue value B_RGBW, and the white value WOPT.

Returning to FIG. 7A, in some embodiments, RGBW block 604 can implement metamere mapping in which some of the brightness of the white sub-pixel (WOPT) calculated by calculate white calculation block 710 can be transferred to the other red, green, and blue sub-pixels to boost their respective luminance values. This may be beneficial, because for some display panels 304, and particularly those relying upon electrowetting technologies, it can be difficult to achieve lower luminance levels.

Figure 7C:
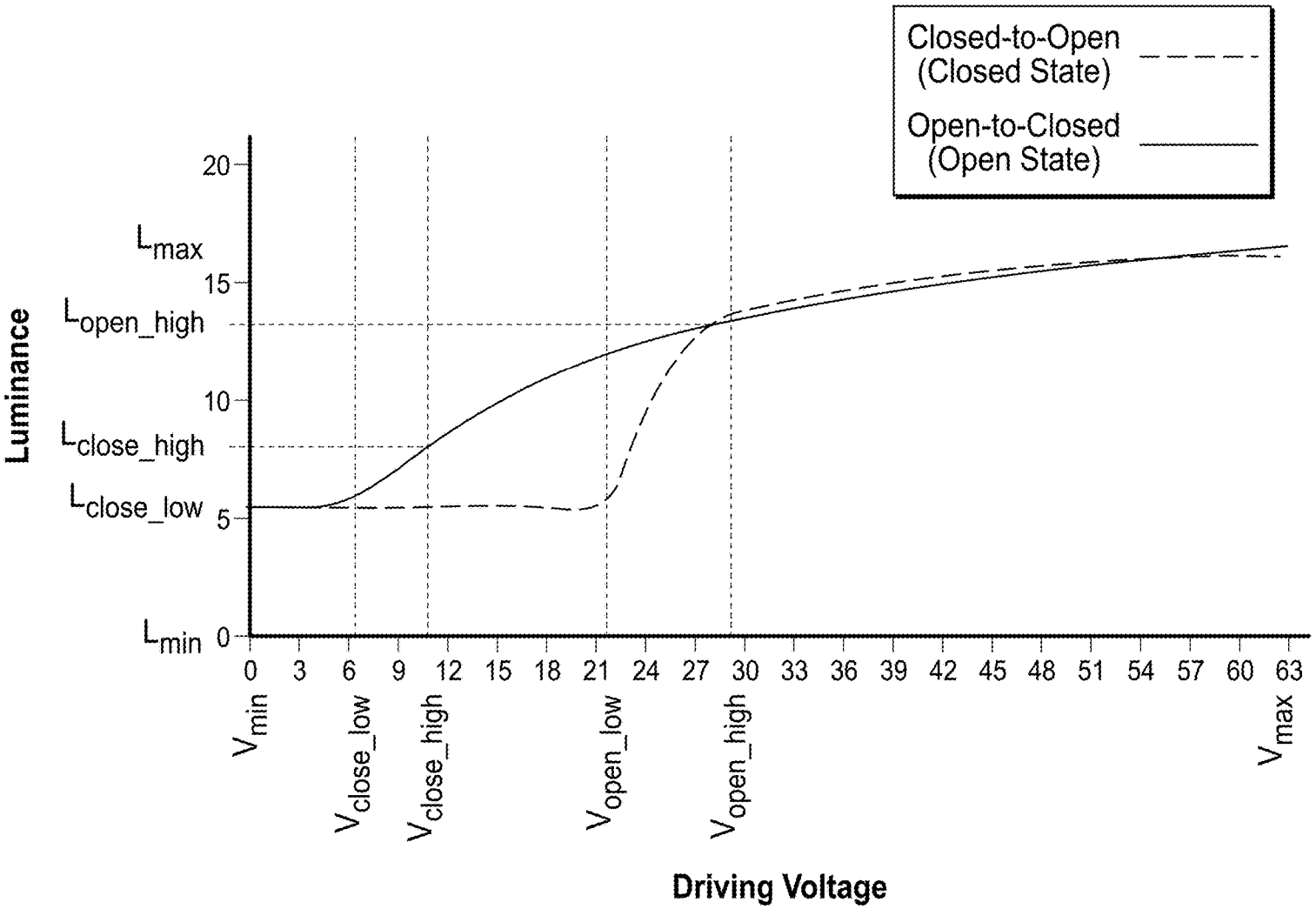
FIG. 7C is a graph illustrating a luminance hysteresis effect for an average sub-pixel within an electrowetting display device.

The dependency of a sub-pixel's luminance can depend upon a prior state of the sub-pixel. The effect is referred to as hysteresis. FIG. 7C is a graph illustrating this hysteresis effect for an average sub-pixel within a display. In the graph, the horizontal axis represents a sub-pixel's driving voltage, while the vertical axis represents the sub-pixel's actual luminance. The graph shows two curves. The first rising curve (from left to right in the figure) shows the average sub-pixel's luminance versus driving voltage when the sub-pixel is transitioned from a closed state to an open state. The falling curve (from left to right in the figure) shows the average sub-pixel's luminance versus driving voltage when the sub-pixel is transitioned from an open state to a closed state. As shown by the graph, the sub-pixel's luminance shows relatively significant hysteresis spanning 25% of the driving voltage range and 60% of the luminance range.

Starting with a low driving voltage $V_{min}$ and a group of closed-state sub-pixels, their average luminance has a corresponding minimum value $L_{min}$. These sub-pixels, being driven at a low driving voltage have been forced closed and are, consequently in a closed state. As the driving voltage increases, the luminance of those pixels will move along the closed-to-open curve. Accordingly, being in a closed-state does not necessarily mean that a sub-pixel is fully closed. In fact, a sub-pixel that is in a closed state could be partially open as its luminance state moves along the closed-to-open curve, as shown in FIG. 7C.

When the driving voltage increases beyond $V_{open_low}$ the average luminance of the closed-state sub-pixels gradually starts to increase, as some individual sub-pixels begin opening to a luminance level close to $L_{open_high}$, while others remain closed at the luminance level $L_{close_low}$ (e.g., a minimum luminance level). In the mid-point between $V_{open_low}$ and $V_{open_high}$ the luminance increases at a faster rate, as more sub-pixels begin opening. When reaching the voltage level $V_{open_high}$, all sub-pixels have a high probability (e.g., greater than 95%) of being open. While each open sub-pixel has a luminance of $L_{open_high}$, the average luminance of these pixels is also $L_{open_high}$. When increasing the driving voltage towards $V_{max}$ the sub-pixel luminance increases to $L_{max}$.

When the driving voltage for a sub-pixel reaches or exceeds $V_{open_high}$, the closed-state sub-pixels have been forced open and enters an open state. Once the sub-pixels have entered the open state, variations in the driving voltage of the open-state sub-pixels will cause the luminance of those sub-pixels to move along the open-to-closed curve. As such, a sub-pixel that is in an open state is not necessarily 100% open. As the driving voltage of an open-state sub-pixel is varied, the luminance of the open-state sub-pixel travels along the open-to-closed curve and, as such, the luminance and the degree to which the sub-pixel is open, will vary.

In the present disclosure, $L_{open_high}$ refers to a lowest luminance level above which a closed-state sub-pixel transitions to an open-state sub-pixel from a closed-state sub-pixel. $L_{open_high}$, therefore, is a luminance level corresponding to a driving voltage level above which a closed sub-pixel has a high probability (e.g., greater than 95%) of opening when driven to this driving voltage for at least one addressing cycle.

In the present disclosure, $L_{close_high}$ refers to a lowest luminance above which an open state sub-pixel will remain open before closing to a minimum luminance value. Or, alternatively, a highest luminance below which an open sub-pixel will close. $L_{close_high}$, therefore, is a lowest luminance corresponding to a lowest driving voltage level above which an open sub-pixel has a high probability (e.g., greater than 95%) of remaining open.

When a group of sub-pixels is transitioning from closed to opened, for driving voltages between $V_{open_low}$ and $V_{open_high}$, the actual luminance of a particular sub-pixel cannot be predicted with confidence, as the moment of actual opening, corresponding to the actual driving voltage, has a statistical variation.

Conversely, when starting with a high driving voltage $V_{max}$, the average sub-pixel luminance has a maximum value $L_{max}$ as all the sub-pixels are fully open. For driving voltages above $V_{close_high}$ the luminance of the sub-pixels is relatively linear. But when the driving voltage decreases below $V_{close_high}$ along the open-to-closed curve, the average luminance gradually starts to decrease faster, as some individual sub-pixels are closing to the luminance level $L_{close_low}$, while others remain opened at the luminance level close to $L_{close_high}$. In the mid-point between $V_{close_low}$ and $V_{close_high}$ the luminance decreases more rapidly, as more sub-pixels begin closing. When reaching the voltage level $V_{close_low}$ all sub-pixels are closed. While each sub-pixel has a luminance of $L_{close_low}$, the average luminance of these pixels is also $L_{close_low}$. For driving opened sub-pixels with voltages above $V_{close_high}$, the sub-pixel's luminance is known and predictable. Similarly, for driving voltages below $V_{close_low}$, the sub-pixel is known to be closed and with minimum luminance $L_{min}$ equal to $L_{close_low}$. When a group of sub-pixels is transitioning from opened to closed, for driving voltages between $V_{close_low}$ and $V_{close_high}$, the state of a particular sub-pixel cannot be known with confidence, as the moment of opening, corresponding to the actual driving voltage, has a statistical variation.

Accordingly, for driving voltage values between $V_{close_low}$ and $V_{close_high}$, in the case of a sub-pixel transitioning from open-to-closed (i.e., a sub-pixel in an open state), and for driving voltage values between $V_{open_low}$ and $V_{open_high}$, in the case of a sub-pixel transitioning from closed-to-open (i.e., a sub-pixel in a closed state), the particular sub-pixel luminance cannot be confidently predicted.

Due to this hysteresis effect—the difference between the rising and falling driving voltage-luminance curves—and the uncertain sub-pixel opening and closing characteristics, given a particular initial state of a sub-pixel (e.g., closed state or open state) there are certain luminance levels that cannot be reliably achieved should the sub-pixel simply be driven at a driving voltage corresponding to the target luminance level.

To provide for the predictable achievement of a target luminance levels for a particular sub-pixel, therefore, a quantization process is provided in which luminance levels that are difficult to achieve within a particular sub-pixel are avoided (i.e., not used). This approach may also mitigate the effects of the relatively large gain in parts of the display device's grayscale range, as well as the reduced number of brightness or luminance levels due to the limited resolution of the display driver interface. Because, in some embodiments, this quantization process may introduce visual artifacts, like missing grey levels, error diffusion techniques are also presented to mitigate the lack of grey scale resolution in darker colors and possible color banding. The error diffusion technique may involve the utilization of PENTILE-specific error diffusion coefficients, adaptive metamere swaps, and adaptive spatial subsampling, as described herein.

The quantization scheme is in large part determined by the lowest luminance level above which the luminance for a particular sub-pixel can be set accurately, referred to herein at the threshold luminance value Lth. At lower luminance levels, the luminance of a particular sub-pixel cannot be set precisely. With reference to FIG. 7C, for example, Lth may be equal to Lclose_low. In other embodiments, however, Lth may be any suitable luminance level, such as Lclose_high or Lopen_high.

Referring back to FIG. 7A, with Lth defined, metamere transfer block 712, is configured to determine whether the white luminance level WOPT falls below the threshold level Lth. If so, metamere transfer block 712 may simply set the white level to a minimum white level (which is a white level that can be reliably achieved by a white sub-pixel corresponding to a minimum luminance value for the white sub-pixel) and transfer some or all of the white level WOPT received from white calculation block 710 to the RGB values received from node 708.

By setting the luminance level of the white sub-pixel to a minimum white luminance level, the actual luminance level of the white sub-pixel as compared to the target luminance level is reduced, resulting in a quantization error. The quantization error can be determined by calculating a difference between the target white luminance level (i.e., WOPT) and the minimum white luminance level.

If a quantization error exists, that error is distributed to the luminance values of other nearby or neighbor sub-pixels in the display device. The set of neighbor sub-pixels may be identified in any manner. For example, the set of neighbor sub-pixels may include any number of sub-pixels. The neighbor sub-pixels may all occupy the same row within the display device (which may or may not include the white sub-pixel being processed) or may occupy two or more different rows of sub-pixels within the display device. The set of neighbor sub-pixels may include sub-pixels that are adjacent to (i.e., with no intervening sub-pixel) the white sub-pixel being processed (i.e., the white sub-pixel for which the value WOPT was calculated). The set of neighbor sub-pixels may also include sub-pixels of any colors (including white sub-pixels). The neighbor sub-pixels may include adjacent sub-pixels. Two adjacent sub-pixels are sufficiently close to one another that there is no intervening sub-pixel located between the two adjacent sub-pixels. The set of neighbor sub-pixels may also include neighbor sub-pixels that are not adjacent to the white sub-pixel being processed. The set of neighbor sub-pixels may include sub-pixels of different colors and may include white sub-pixels, in some cases.

After the set of neighbor sub-pixels is identified, the quantization error is distributed amongst the set of neighbor sub-pixels. This may involve dividing the quantization error by the number of sub-pixels in the set of neighbor sub-pixels and then allocating the result to each one of the neighbor sub-pixels. For example, if there are three identified neighbor sub-pixels, the quantization error may be divided into thirds (⅓) and distributed to each of the neighbor sub-pixels. This involves summing the quantization error divided by the number of sub-pixels in the set of neighbor sub-pixels to the target luminance levels for each sub-pixel in the set of neighbor sub-pixels. In other embodiments, however, the quantization error may not be distributed evenly amongst the neighbor sub-pixels. In some cases, neighbor sub-pixels of particular colors may be allocated a greater share of the quantization error than neighbor sub-pixels of other colors.

With the white luminance level WOPT redistributed amongst neighbor sub-pixels if WOPT falls below the threshold luminance level Lth, metamere transfer block 712 transmits the resulting RGBW luminance values to mode selection block 714 for ultimate output through buffer 716 to output node 718.

As discussed above RGBW block 604 can operate in a number of different modes. The current mode of operation (which is a two-bit input to mode selection block 714) determines which of the inputs of mode selection block 714 is connected to the output so that data receive via that input is passed along to buffer 716 and, ultimately, output 718.

During the normal mode of operation that calls for converting RGB input luminance values into RGBW luminance values (i.e., when the mode input has a first value), the mode input causes input 720 of mode selection block 714 to be active.

In another mode of operation (i.e., when the mode input has a second value), however, RGBW block 604 receives as an input RGB data that, rather than requiring conversion into the RGBW color space, has already been processed to include RGBW data. In that case, the RGBW data may be stored within the R and G values of the input RGB data, with the B value being unused. In that case, the input RGB data is simply passed through processor 726, which is configured to retrieve the R and G values from the input RGB data. Using the retrieved values, processor 726 decodes the R and G values to extract red, green, blue, and white values which are passed along to input 724 of mode selection block 714. With the mode input set to the second value, input 724 of mode selection block 714 is active and the RGBW values received at input 724 are passed along to the output of mode selection block 714.

Finally, in a third mode of operation (i.e., when the mode input has a third value) the input RGB luminance data can be processed monochromatically. In a monochromatic operation, the RGBW sub-pixels in a pixel of display panel 304 will each be assigned the same luminance value, resulting in a greyscale output that does not take on a particular color. When operating monochromatically, the input red, green, and blue luminance values are passed through a transfer function (see function 728) that, based upon the input RGB luminance values, calculates a single grey level or luminance value W, which is repeated for each component (i.e., sub-pixel) of the output pixel in display panel 304 that corresponds to the pixel in the input image data associated with the input RGB luminance data. Accordingly, the output of function 728 is the value WWWW in the WWWW color space.

The monochromatic RGBW conversion of RGBW block 604 also includes an optional metamere transfer block 730. If the luminance value W determined by function 728 is less than the threshold luminance value, metamere transfer block 730 may be configured to distribute all or some of the luminance value W to other neighboring pixels. For example, when the luminance value W is less than half the threshold luminance value, the brightness of the first sub-set W of sub-pixels is transferred to a different neighbouring set W of sub-pixels, limited by the dynamic range of the sub-pixels. When the luminance value W is greater than half the threshold luminance value but still less than the threshold luminance value, the brightness of the W sub-pixel is partially transferred to the related R,G and B subpixels, limited by the dynamic range of the sub-pixels. This method matches the horizontal resolution of the video input and may be optimized for sharpness of vertical lines. With metamere transfer performed by metamere transfer block 730, the output RGBW values (which contain the equal luminance values WWWW) are passed to input 722 of mode selection block 714. With the mode input set to the third value, input 722 of mode selection block 714 is active and the RGBW values received at input 722 are passed along to the output of mode selection block 714.

RGBW block 604 receives an input (not shown) that determines whether the logic of RGBW block 604 is enabled. If enabled, RGBW block 604 operates to perform RGBW conversion as described and illustrated in FIG. 7A. If, however, RGBW block 604 is not enabled, RGBW block 604 may pass the input data straight through to an output without modifying the data. This may be a useful mode of operation, for example, if another external component (e.g., host processor 302) has already performed RGBW conversion on the data being input to RGBW block 604 data before passing that data into RGBW block 604.

Returning to FIG. 6, filter block 606 receives as input the RGBW luminance data from RGBW block 604. Filter block 606 is generally configured to implement spatial filtering of the RGBW luminance data, which can be a mechanism to minimum or reduce the occurrence of visual phenomenon within the output of display panel 304.

For example, with the sub-pixels of display panel 304 arranged in a PENTILE configuration, display panel 304 may not effectively display diagonal lines that are formed from saturated colors. Because certain diagonal regions within the display panel 304 may not contain a large percentage of red sub-pixels, for example, a saturated diagonal red line running through that region may not be depicted very effectively. To minimize the likelihood of such a phenomenon, filter block 606 can identify color-saturated pixels within the input RGBW luminance data. If a color-saturated pixel is identified, the luminance values of the saturated value of the pixel (e.g., the saturated red, green, or blue component) can be at least partially distributed to neighboring sub-pixels of the same color. In essence, this, to some degree, blurs the saturated sub-pixel with that sub-pixels nearest neighbors of the same color, but such blurring can reduce the likelihood that a diagonal line created by a row of saturated sub-pixel can result in unwanted visual artifacts.

Such blurring may be achieved using any suitable approach. In one embodiment, the saturated sub-pixel and the saturated sub-pixel's immediate neighboring 8 sub-pixels of the same color can have their respective luminance values passed through a low-pass filter that will reduce instances of large changes in luminance between the saturated sub-pixel and the sub-pixel's neighbors of the same color. Such a low pass filter may be implemented by filter block 606.

Filter block 606 may also implement further filtering of the input RGBW luminance data. For example, an additional filter may be implemented to balance the edges and improve sharpness characteristics of saturated and un-saturated colored areas within the input data.

PENTILE block 608 receives the filtered RGBW luminance data from filter block 606 and re-arranges the filtered RGBW luminance data to match the sub-pixel layout in the PENTILE configuration of display panel 304. At this point, the RGBW luminance data is associated with pixels presumed to be laid out in rows and columns of square pixels as found in the original input image data received from host processor 302, where the sub-pixel configurations in each pixel are the same. In a PENTILE display, however, the sub-pixel configurations are not the same in every pixel. Instead, different sub-pixel arrangements are specified for each row of sub-pixels in a PENTILE display. Furthermore, the geometry and size of the sub-pixels contained within a PENTILE display may not correspond accurately to the pixels defined within the input image data.

Accordingly, in order to compensate for the arrangement of the sub-pixels within the pixels of a PENTILE display (i.e., the type of sub-pixel arrangement used by display panel 304), PENTILE block 608 is configured to re-arrange the input filtered RGBW luminance data to match the PENTILE sub-pixel configuration of display panel 304. This generally involves PENTILE block 608 selecting the appropriate RGB and W components from sequential pixels of input data and mapping those RGBW components to the related pixels structure of the PENTILE-configured display panel 304. Hence, PENTILE block 608 is configured to re-arrange the RGBW components differently for even and odd rows of pixels within display panel 304 to generate the mapped PENTILE RGBW image data. To compensate for the differences in geometry of pixels within a PENTILE display versus the original input image data, PENTILE block 608 may be configured to combine multiple pixels from the input RGBW luminance data to generate output luminance data for the sub-pixels of a single RGBW pixel in display panel 304. For example, in one embodiment, the input RGBW luminance data for two input pixels (i.e., containing 8 luminance values) are combined to generate a single set of RGBW luminance for a single pixel in the display panel 304.

As discussed above, within an electrowetting display device, the opening and closing behavior of the sub-pixels of the device's pixels can make it relatively difficult to predictably set the sub-pixels to some luminance levels—particularly those having relatively low greyscale values. Accordingly, rendering engine 524 includes a low greyscale rendering block 610 that is configured to receive the mapped PENTILE RGBW image data from PENTILE block 608 and quantize the target luminance levels contained in that input data to avoid the difficult-to-achieve luminance levels. The difference between the target luminance levels and the quantized luminance level for a particular sub-pixel is referred to herein as error or quantization error. Low greyscale rendering block 610 then distributes the quantization error to other sub-pixels in the display device by raising or lowering their target luminance levels to compensate.

The degree to which the oil is displaced from its resting position affects the overall luminance of a sub-pixel and, thereby, the sub-pixel's appearance. In an optimal display device, the driving voltage for a particular sub-pixel results in a predictable fluid movement and, thereby, a predictable luminance for that sub-pixel. In real world implementations, however, when a sub-pixel is driven at a particular driving voltage, the resulting luminance for that sub-pixel depends upon the state of the sub-pixel before the driving voltage was applied. If, for example, the sub-pixel was already open when driven at the driving voltage, the resulting luminance may be different than if the sub-pixel was closed before the driving voltage was applied.

Accordingly, the fluid movement within a sub-pixel exhibits hysteresis, making fluid position difficult to accurately predict based solely upon driving voltage. This attribute of electrowetting display sub-pixels consequently makes luminance difficult to control, resulting in potential degradations in overall image quality and/or image artifacts.

To provide for the predictable achievement of a target luminance levels for a particular sub-pixel, therefore, a quantization process is provided in which luminance levels that are difficult to achieve within a particular sub-pixel are avoided (i.e., not used). Because, in some embodiments, this quantization process may introduce visual artifacts, like missing grey levels, error diffusion techniques are also presented to mitigate the lack of grey scale resolution in darker colors and possible color banding.

The quantization scheme is in large part determined by the lowest luminance level above which the luminance for a particular sub-pixel can be set accurately, referred to herein at the threshold luminance level Lth. At lower luminance levels, the luminance of a particular sub-pixel cannot be set precisely. With reference to FIG. 7C, described above, Lth may be equal to Lclose_low. In other embodiments, however, Lth may be any suitable luminance level, such as Lclose_high or Lopen_high.

With Lth defined—the value Lth may be specified within settings register 516, for example, low greyscale rendering block 610 is configured to quantize the luminance values in the mapped PENTILE RGBW image data. Because the quantization scheme compensates for sub-pixel state hysteresis effects described above, the quantization of luminance values for a particular sub-pixel depends on the sub-pixel's previous state—e.g., whether the sub-pixel is open or closed.

Figure 8A:
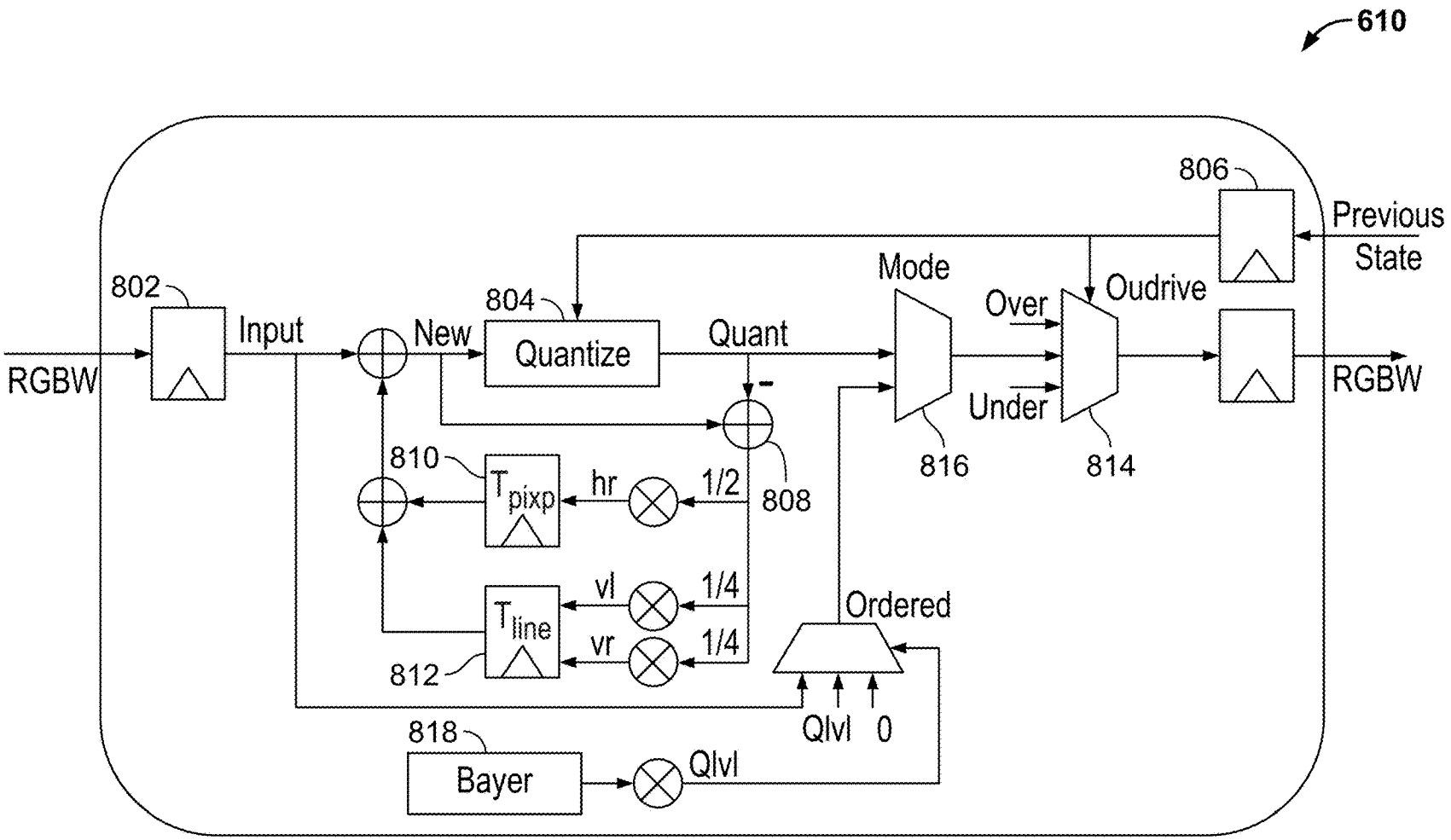
FIG. 8A is a logical block diagram depicting the functional components of a low greyscale rendering block of the rendering engine of FIG. 6.

FIG. 8A is a logical block diagram depicting the functional components of low greyscale rendering block 610. As depicted, low greyscale rendering block 610 includes input buffer 802 configured to receive the mapped PENTILE RGBW output data of PENTILE block 608. That image data is then passed to quantization block 804, where the image data is quantized to avoid luminance levels between a minimum luminance level (e.g., a zero luminance level) and the threshold luminance level Lth. The output of quantization block 804 is the quantized luminance level.

Figure 8B:
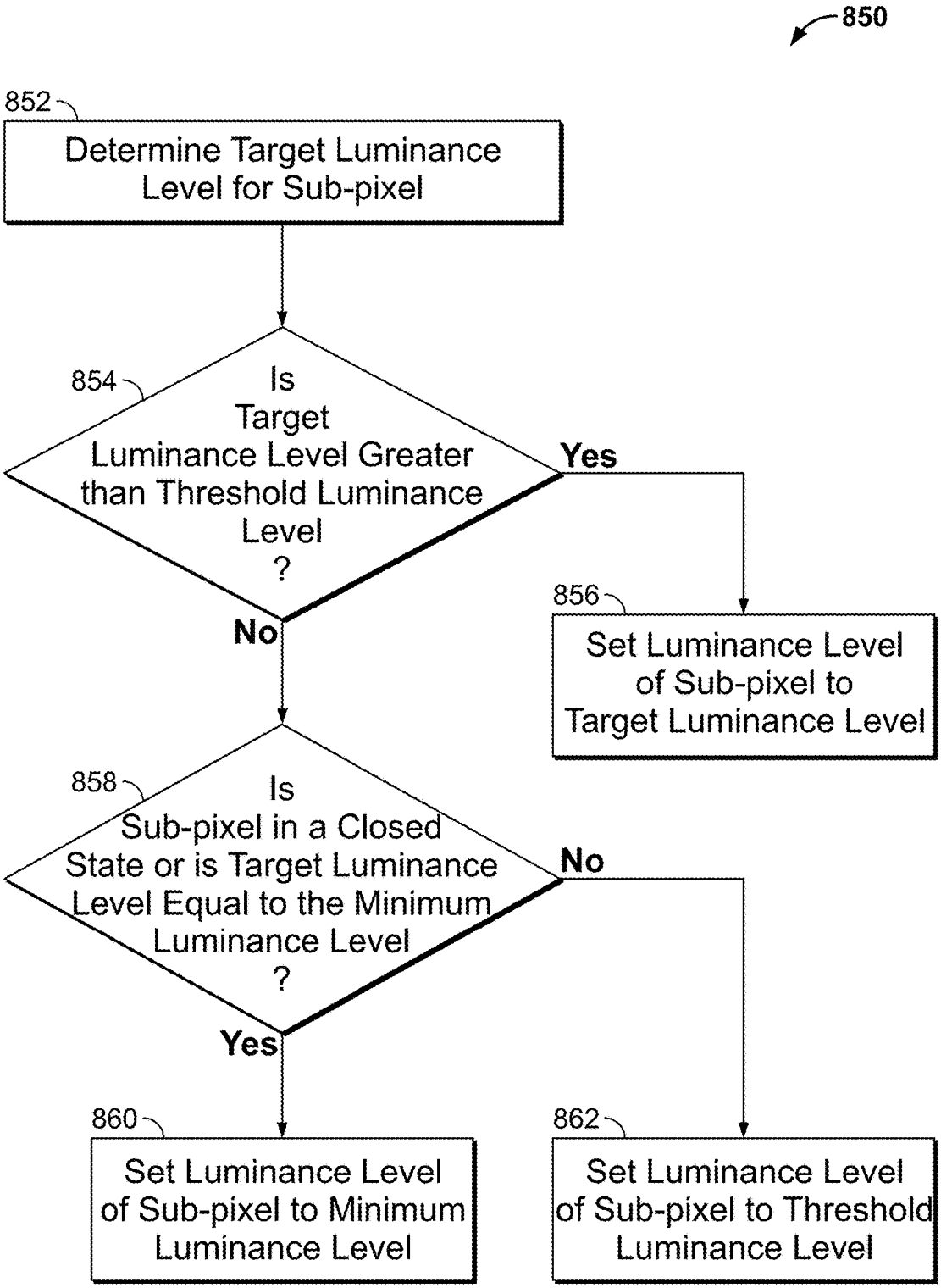
FIG. 8B is a flowchart illustrating a method for quantizing a target luminance value for a sub-pixel in a display device that may be implemented by a quantization block of the low greyscale rendering block of FIG. 8A.

FIG. 8B is a flowchart illustrating a method for quantizing a target luminance value for a sub-pixel in a display device that may be implemented by quantization block 804 of low greyscale rendering block 610. Method 850 could be executed iteratively against each the RGBW values for each sub-pixel or against a number of sub-pixels at the same time. The method may be executed against the luminance values for a series of sub-pixels in a particular row of sub-pixels before being executed against sub-pixels in the next adjoining row.

In step 852 a target luminance level is determined for the current sub-pixel being processed. As described above, the target luminance value is received from buffer 802 and can be retrieved from the mapped PENTILE RGBW values received by buffer 802. In step 854, a determination is made as to whether the target luminance level for the current sub-pixel is greater than the threshold luminance level. If so, the target luminance level is sufficiently high (i.e., exceeds the threshold level) then the sub-pixel can predictably be set to the target luminance level. As such, in step 856, the luminance for the sub-pixel is set to the target luminance level.

If, however, in step 854 it was determined that the target luminance level was less than the threshold level, then it may not be possible to reliably set the sub-pixel to the target luminance level. As such, the luminance level of the sub-pixel is quantized to either a minimum luminance level or the threshold luminance level, both of which represent luminance levels that can be confidently established within the sub-pixel.

In step 858, therefore, a determination is made as to whether the sub-pixel is in a closed state or whether the target luminance level is equal to a minimum luminance level. Referring to FIG. 8A, the determination of the open or closed state for the sub-pixel may involve quantization block 804 receiving previous state data for the present sub-pixel from buffer 806. As described below, buffer 806 may receive the previous-state data for the present sub-pixel from an output memory controller (see output memory controller 526 of FIG. 9A, described below). The previous state data may take the form of a binary value (e.g., a 0 or 1), where a first binary state indicates that the sub-pixel being processed is currently in a closed state, and the second binary state indicates that the sub-pixel being processed is currently in an open state. In other embodiments, the previous state data may include the current luminance value of the sub-pixel being processed. In that case, quantization block 804 may be configured to analyze the current luminance value of the sub-pixel being processed to determine whether sub-pixel is currently in an open or a closed state.

In either case, the sub-pixel can be reliably set to the minimum luminance level (e.g., driven with a minimum driving voltage). As such, in step 860, if the sub-pixel is closed or the target luminance level is equal to the minimum luminance level, the luminance of the sub-pixel is set to the minimum luminance level.

If, however, in step 858 it was determined that the sub-pixel was in an open state and that the target luminance level was not the minimum luminance level, the sub-pixel can reliably be set to a luminance level of the threshold luminance level. As such, in step 862, the luminance level of the sub-pixel is set to the threshold luminance level.

Accordingly, after completion of the quantization method illustrated in FIG. 8B, the target luminance level for a particular sub-pixel is quantized to a value of either the minimum luminance level or values equal to or greater than the threshold luminance level. Luminance levels between the minimum luminance level and the threshold luminance level are thereby avoided. The quantized luminance level is then outputted by quantization block 804 of FIG. 8A.

Although this quantization approach may avoid the setting of sub-pixels to luminance values that cannot be accurately realized, this approach may result in some visual artifacts that could be noticed by an observer. This may be because the quantization scheme generally identifies a band of low-greyscale luminance levels (e.g., luminance levels greater than 0 but less than Lth) as being invalid. Those luminance levels, therefore, are not used, potentially resulting in visual artifacts in the display device. To improve the perceived resolution of grayscales within the images rendered by the display device, therefore, an error diffusion scheme may be utilized to distribute the luminance error resulting from the luminance level quantization of a single sub-pixel to other sub-pixels within the display to achieve a target average luminance level over a number of sub-pixels.

In some embodiments, the quantization error is only distributed to other sub-pixels of the same color.

Figure 8C:
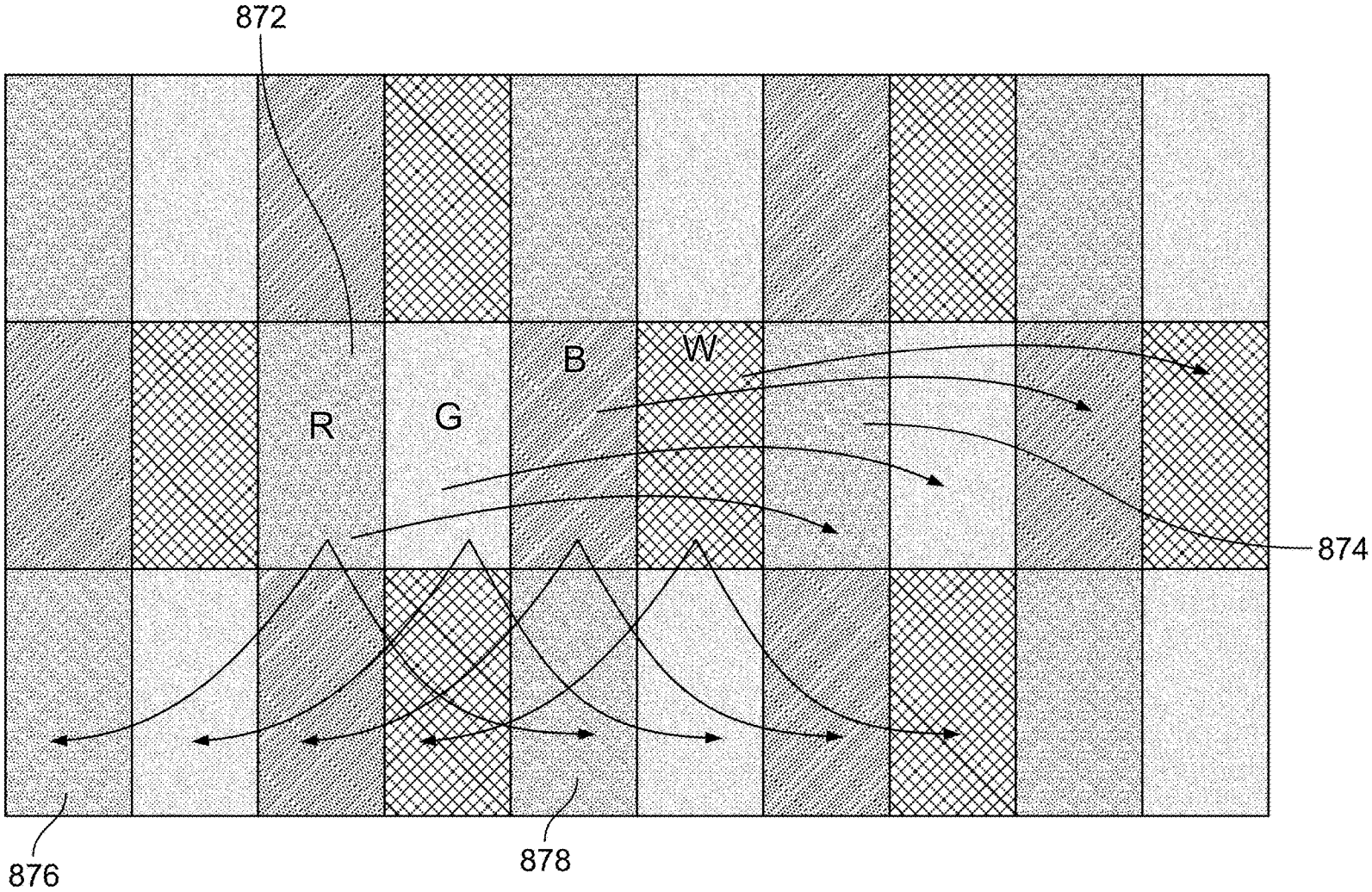
FIG. 8C depicts steps of an error diffusion method that may be implemented by a low greyscale rendering block on quantized luminance data for a first sub-pixel.

FIG. 8C depicts steps of the error diffusion method that may be implemented by low greyscale rendering block 610 on quantized luminance data for a first sub-pixel 872. The error diffusion method may be implemented for each sub-pixel within a display, with the low greyscale rendering block 610 implementing the method for a first sub-pixel and then moving to a next sub-pixel and re-executing the method.

First, a determination is made as to whether the quantization of the target luminance level resulted in a luminance level quantization error. The error can be determined by calculating the difference between the target luminance value for the sub-pixel and the luminance value to which the sub-pixel was actually set (i.e., the quantized luminance value). In FIG. 8A, subtraction block 808 determines the luminance level quantization error by calculating a difference between the output of quantization block 804 (the quantized luminance level) and the original target luminance level.

If there is no error (i.e., the target luminance level for the sub-pixel and the quantized luminance level are the same) there is no error to distribute to other sub-pixels within the display and low greyscale rendering block 610 moves on to calculating quantized luminance levels for the luminance data of other sub-pixels.

If, however, subtraction block 808 has a non-zero output indicating that there exists a luminance level quantization error (i.e., the target luminance level for the sub-pixel is not equal to the quantized luminance level), the luminance level quantization error is distributed amongst other sub-pixels. Accordingly, after the quantization error is determined by calculating the difference between the target luminance level for the sub-pixel and the quantized luminance level, that quantization error is used to modify the luminance values for other sub-pixels in the vicinity of the sub-pixel being processed.

As depicted in FIG. 8A, a first fraction of the luminance level quantization error is allocated to a first sub-pixel in the vicinity of the sub-pixel being analyzed. In this example, the first sub-pixel is the sub-pixel of the same color as the sub-pixel being analyzed that is located in the pixel to the right of and adjacent to the pixel containing the sub-pixel being analyzed. In FIG. 8A, this is the sub-pixel labeled hr. Referring to FIG. 8C, that is sub-pixel 874. In one specific embodiment, ½ of the luminance level quantization error is allocated to sub-pixel 874. In order to allocate the first fraction of the luminance level quantization error to sub-pixel 874, a luminance level amount equal to the luminance level quantization error multiplied by ½ is added to the target luminance level of sub-pixel 874. In various other embodiments, fractions other than ½ may be used depending upon the design of the display device and arrangement of sub-pixels in the display panel 304.

A second fraction of the luminance level quantization error is allocated to a second sub-pixel in the vicinity of the sub-pixel being analyzed. In this example, the second sub-pixel is the sub-pixel of the same color as the sub-pixel being analyzed that is located in the pixel to the bottom-left of and adjacent to (i.e., with no intervening pixel) the pixel containing the sub-pixel being analyzed. In FIG. 8A, this is the sub-pixel labeled vl. Referring to FIG. 8C, that is sub-pixel 876. In one specific embodiment, ¼ of the luminance level quantization error is allocated to sub-pixel 876. In order to allocate the second fraction of the luminance level quantization error to sub-pixel 876, a luminance level amount equal to the luminance level quantization error multiplied by ¼ is added to the target luminance level of sub-pixel 876. In various other embodiments, fractions other than ¼ may be used depending upon the design of the display device and arrangement of sub-pixels in the display panel 304.

A third fraction of the luminance level quantization error is allocated to a third sub-pixel in the vicinity of the sub-pixel being analyzed. In this example, the third sub-pixel is the sub-pixel of the same color as the sub-pixel being analyzed that is located in the pixel to the bottom-right of and adjacent to (i.e., with no intervening pixel) the pixel containing the sub-pixel being analyzed. In FIG. 8A, this is the sub-pixel labeled vr. Referring to FIG. 8C, that is sub-pixel 878. In one specific embodiment, ¼ of the luminance level quantization error is allocated to sub-pixel 878. In order to allocate the third fraction of the luminance level quantization error to sub-pixel 878, a luminance level amount equal to the luminance level quantization error multiplied by ¼ is added to the target luminance level of sub-pixel 878. In various other embodiments, fractions other than ¼ may be used depending upon the design of the display device and arrangement of sub-pixels in the display panel 304.

With the luminance value of the sub-pixel being processed set and the luminance level quantization error distributed to other sub-pixels, low greyscale rendering block 610 then moves on and begins processing the input luminance data for the next sub-pixel in the display. The new target luminance levels calculated for sub-pixels hr, vl, and vr will be used when low greyscale rendering blocks 610 quantizes their target luminance values.

To facilitate the modification of target luminance values for sub-pixels in the proximity of the sub-pixel for which luminance data is being processed by low greyscale rendering block 610, low greyscale rendering block 610 may include a number of timing buffers configured to store the luminance value adjustments for each of sub-pixels hr, vl, and vr resulting from the error diffusion approach described above. Then, when the original target luminance values for those pixels are ultimately processed by low greyscale rendering block 610, the timing buffers combine the luminance value adjustments resulting from error diffusion process with the original target luminance value.

With reference to FIG. 8A, timing buffer 810 stores the luminance value adjustment resulting from error diffusion for sub-pixel hr. When the target luminance value for sub-pixel hr is being processed, therefore, the adjustment can be retrieved from timing buffer 810 and combined with the target luminance value. The resulting combination is then supplied as an input to quantization block 804 for processing.

Similarly, timing buffer 812 stores the luminance value adjustments resulting from error diffusion for sub-pixels vl and vr. When the target luminance values for sub-pixels vl and vr are processed the adjustments can be retrieved from timing buffer 812 and combined with the target luminance value for sub-pixels vl and vr. The resulting combinations can then be supplied as an input to quantization block 804 for processing.

The error diffusion approach implemented by low greyscale rendering block 610 is configured for use in display device 300 including a display panel 304 having sub-pixels arranged in accordance with a PENTILE structure. In contrast to a more conventional "stripe" sub-pixel arrangement, in which case display errors can be diffused to the nearest sub-pixel, which can be directly below the sub-pixel being analyzed, in the sub-pixel arrangement illustrated in FIG. 8C error is diffused to a number of nearby sub-pixels where the nearby sub-pixels may be on the same row of sub-pixels as the sub-pixel being analyzed or a different row. By allocating ½ of the luminance level error to a sub-pixel in the same row of pixels as the sub-pixel being processed, a majority of the luminance level error is allocated to the closest sub-pixel that can be addressed closest in time. The other nearby sub-pixels (e.g., sub-pixels 556 and 558 in FIG. 8C) are in a different row and, therefore, are not addressed at the same time as sub-pixel 554. As such, a reduced amount of the luminance level error (¼ each) is allocated to those sub-pixels.

As depicted in FIG. 8A, in addition to the quantization and error diffusion scheme implemented by quantization block 804, low greyscale rendering block 610 can also implement alternative dithering algorithms on the mapped PENTILE RGBW image data output data of PENTILE block 608. Different dithering algorithms may perform differently when rendering different type of image data. At very low grey scale values, for example, the low greyscale rendering approach described above may generate some unwanted visual artifacts. In that case, the alternative dithering algorithm may be implemented to provide different performance when rendering different types of image data.

For example, Bayer diffusion block 818 can implement a Bayer image diffusion algorithm on the input data. Bayer diffusion does not rely on feedback of a sub-pixels prior state (in contrast to the diffusion approach implemented by blocks 804 and 808 of low greyscale rendering block 610). Instead, Bayer diffusion relies upon a predetermined matrix of values that specify how quantization errors should be diffused into sub-pixels nearby the sub-pixel being processed. The predetermined matrix may, for example, include a number of weighting values that dictate an amount of the quantization error that should be moved to nearby sub-pixels. The weightings are predetermined and can be configured based upon attributes of display panel 304, such as the layout of sub-pixels within display panel 304. Because Bayer relies upon a predetermined weighting matrix rather than a feedback approach, Bayer diffusion block 818 may be more efficient and consume less electrical energy than other diffusion approaches. The output of Bayer diffusion block 818 is fed into selection block 816, along with the output from quantization block 804. A mode input to selection block 816 determines whether selection block 816 passes along the output of quantization block 804 or Bayer diffusion block 818 into oublock 814. Accordingly, the mode selection (which may be an input from settings register 516) can determine which dithering scheme is implemented by low greyscale rendering block 610.

In addition to the hysteresis effects described above, electrowetting sub-pixels can also exhibit a behavior in which too-rapid changes to the sub-pixel's luminance can cause unwanted visual artifacts. For example, if a closed sub-pixel (i.e., a sub-pixel in which the oil is distributed evenly through the sub-pixel rendering the sub-pixel black) is subjected to a maximum or relatively high driving voltage (i.e., corresponding to a high luminance value), such a rapid change in driving voltage can shock the oil causing the oil to break into small droplets within the sub-pixel rather than moving to one side of the sub-pixel into a single coherent droplet. Similar effects can be observed when a fully open sub-pixel is driven with a minimum driving voltage.

To reduce the likelihood of these effects, low greyscale rendering block 610 may include an optional over/under intermediate drive system (oudrive) implemented by oublock 814. As described below, oublock 814 is configured to detect when the quantized luminance value for the sub-pixel being processed, once applied as a corresponding driving voltage, could result in a too-rapid change in driving voltage and possible oil breakage. In that case, oublock 814 will replace the quantized luminance value with an intermediate luminance value (e.g., a value between the sub-pixel's current luminance value and the quantized luminance). The sub-pixel will then be set to the intermediate luminance value. This enables the sub-pixel to transition gradually through the intermediate luminance value, reducing the likelihood of oil breakage.

For example, in an embodiment of display device 300, the luminance values for sub-pixels can have values ranging from 0 (a minimum luminance value) to 63 (a minimum luminance value). Due to the hysteresis effects describes above, however, certain low-greyscale luminance values cannot be achieved reliably. Accordingly, luminance values 1-19 may not be used, with luminance value 20 being a minimum non-zero luminance value that can be achieved reliably. If a sub-pixel were to be closed (e.g., a luminance value of 0) and then set to a luminance value of 55, that could result in oil breakage due to the rapid, abrupt change in luminance. In that case, the sub-pixel may be temporarily driven to a luminance value of 25 (i.e., under driven), before being set to the full luminance value of 55. By temporarily under-driving the sub-pixel to a luminance level of 25, the sub-pixel can open more slowly, with less shock and less likelihood of oil breakage.

In the present disclosure, if a closed sub-pixel is to be set to a luminance value greater a threshold Lou max (e.g., a luminance value of 40 in a scale that ranges from 0 to 63), the sub-pixel must first be under driven to a luminance value of Ludrive (e.g., a luminance value of 25 in a scale that ranges from 0 to 63). If the closed sub-pixel were to be set immediately to the luminance value that is greater that Lou_max, there is risk that the oil in the sub-pixel could break into multiple droplets. Conversely, if an open sub-pixel is to be set to a luminance value less than Lou_min (e.g., a luminance value of 20 in a scale that ranges from 0 to 63), the sub-pixel must first be set to a luminance value of Lodrive (e.g., a luminance value of 22 in a scale that ranges from 0 to 63), which is greater than the sub-pixel's quantized luminance value. If the open sub-pixel were to be set straight to the luminance value that is less that Lou_min, there is risk that the oil in the sub-pixel could break into multiple droplets.

Figure 8D:
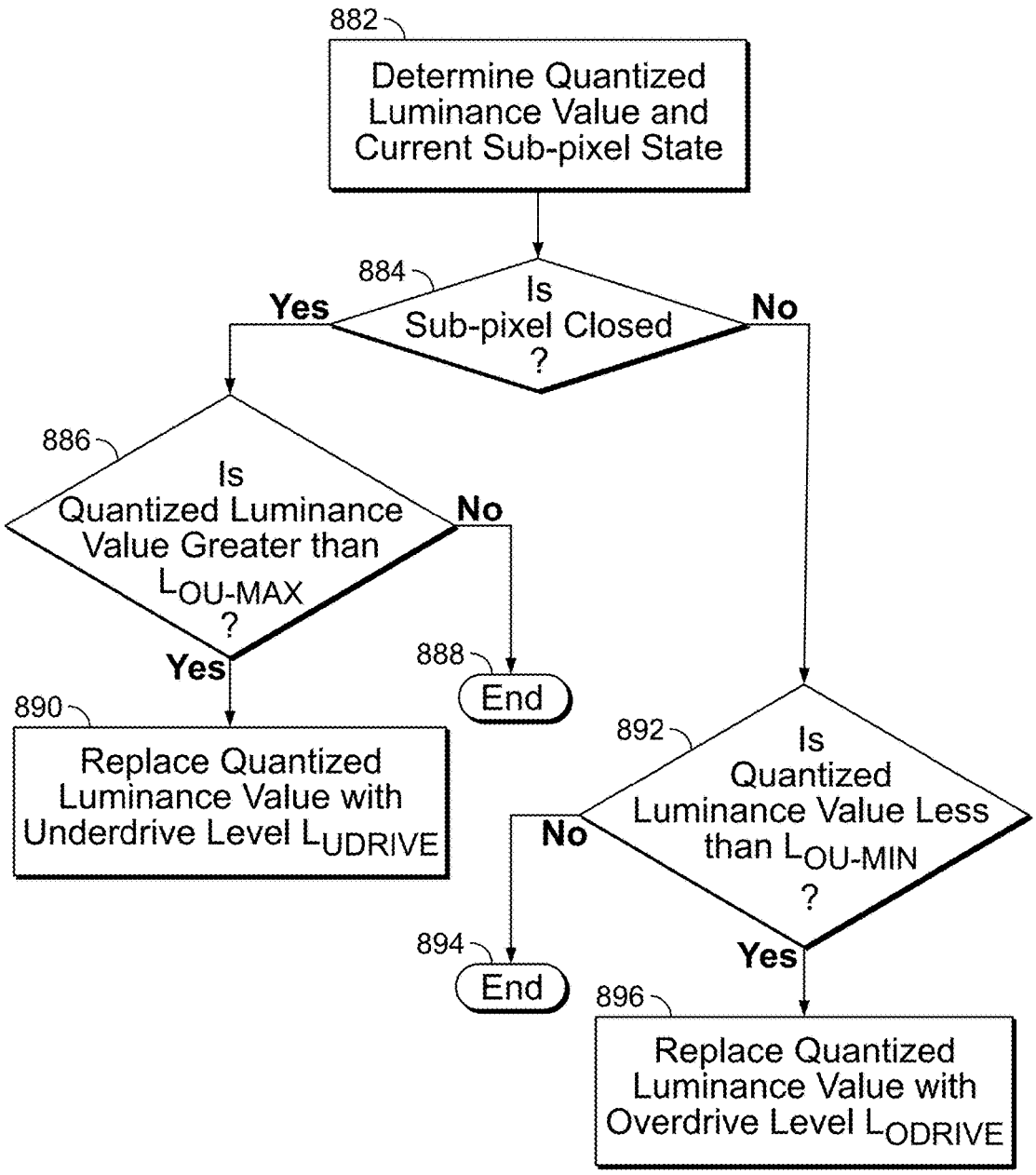
FIG. 8D is a flowchart depicting a method of over and underdrive that may be implemented by a logical block of the low greyscale rendering block of FIG. 8A.

FIG. 8D is a flowchart depicting a method of setting sub-pixel luminance values that may be implemented by oublock 814 of low greyscale rendering block 610. In step 882, the quantized luminance value for the sub-pixel and the sub-pixel current state is determined. The quantized luminance value is received from block 816, while the sub-pixel's current state is received from buffer 806. As described above, the current state value received from buffer 806 indicates whether the sub-pixel being processed is currently open or closed.

In step 884, oublock 814 determines whether the sub-pixel is currently in a closed state. If so, there may be some risk that if the sub-pixel is set to a luminance value that is too high, the resulting application of a correspondingly high driving voltage could shock the oil in the sub-pixel, causing the oil to break into many droplets. Accordingly, if the sub-pixel is currently closed, in step 886 oublock 814 determines whether the quantized luminance value for the sub-pixel exceeds a relatively large threshold luminance value Lou max that could cause oil breakage. If not, there is no need to modify the sub-pixel's luminance value and in step 888 the method ends. In that case, oublock 814 can simply output the quantized luminance value that was originally received from block 816.

If, however, in step 886 it is determined that the quantized luminance value for the sub-pixel exceeds Lou_max, there is risk of oil breakage and, as such, in step 890, the quantized luminance value for the sub-pixel is replaced with the luminance value Ludrive. In that case, oublock 814 outputs the Ludrive value as the luminance value for the sub-pixel being processed. This will cause to the sub-pixel to be set to the luminance value of Ludrive for at least one frame, which is a luminance value less than the sub-pixel's quantized luminance value. This reduces the likelihood of oil breakage when the sub-pixel is set in a later frame to luminance values that exceed Lou_max.

If, however, in step 884 it was determined that the sub-pixel being processed is currently open, there may be some risk that if the sub-pixel is set to a luminance value that is too low, the resulting application of a correspondingly low driving voltage could shock the oil in the sub-pixel, causing the oil to break into many droplets. Accordingly, if the sub-pixel is currently open, in step 892 oublock 814 determines whether the quantized luminance value for the sub-pixel is less than a relatively low luminance value Lou_min that could cause oil breakage. If not, there is no need to modify the sub-pixel's luminance value and in step 894 the method ends. In that case, oublock 814 can simply output the quantized luminance value that was originally received from block 816.

If, however, in step 892 it is determined that the quantized luminance value for the sub-pixel is less than Lou_min, in step 896 the quantized luminance value for the sub-pixel is replaced with the luminance value Lodrive, which is a luminance value greater than the sub-pixel's quantized luminance value. In that case, oublock 814 outputs the Lodrive value as the luminance value for the sub-pixel being processed. This will cause to the sub-pixel to be set to the luminance value of Lodrive for at least one frame. This reduces the likelihood of oil breakage when the sub-pixel is set in a later frame to luminance values that is less than Lou_min.

The luminance values Lou_max, Lou_min, Lodrive, Ludrive are generally predetermined values. The values may be determined based upon attributes of the display panel of the display device, or the attributes of other components of the display device. The values may be selected so as to minimize the likelihood of oil breakage, and thereby visual artifacts. Or, alternatively, the values may be selected to minimize power consumption within the display device. The process of steps 892 and 896 of FIG. 8D and the process of steps 886 and 890 of FIG. 8D may each be optional and in some embodiments of low greyscale rendering block 610 may not be performed.

After the RGBW luminance values have been generated by low greyscale rendering block 610, those luminance values are gamma corrected for display on display panel 304 by inverse gamma block 602. As in the case of gamma block 602, inverse gamma block 612 can store look-up tables containing a mapping from a particular RGBW luminance value to a gamma corrected RGBW value. The mappings from luminance value to gamma corrected value can be tailored to compensate for the optical characteristics of display panel 304. For example, if display panel 304 exhibits relatively low contrast, particularly at low luminance values, the mappings stored in the look-up table can be configured to increase the contrast around those relatively low luminance values.

The values of the look-up tables may be stored in settings register 516 enabling external components to update and modify the values stored in the inverse gamma look-up table. The contents of the look-up table can be determined offline, e.g. by using electrowetting display measurement data and a dedicated spreadsheet for calculations. Compensation for a relatively low-contrast display panel 304 can be taken into account while determining the values for the inverse gamma look-up table.

The look-up table may store, for every possible RGBW luminance value, corresponding gamma corrected RGBW values. Such a look-up table can, in some respects, be relatively large and so inverse gamma block 612 may utilize alternative look-up table configurations. For example, the look-up table may only store RGBW conversion values for a subset of possible RGBW luminance values. If an input RGBW luminance value is not contained within the subset of RGBW video values, a gamma corrected RGBW value can be determined by interpolating between the available RGBW luminance values and corresponding gamma corrected values.

One of the control parameters received by inverse gamma block 612 from settings register 516 may include a setting that controls whether the logic of inverse gamma block 612 is enabled. If enabled, inverse gamma block 612 operates to perform gamma correction on input RGBW image data to convert that image data. If, however, inverse gamma block 612 is not enabled, inverse gamma block 612 may pass the input RGBW data straight through to an output without modifying the RGBW data.

In an embodiment of device 300, the resolution of the RGBW video data outputted by inverse gamma block 612 is 8 bits, but the gate drivers 318 and source drivers 320 of device 300 (see FIG. 3) are only configured to set the sub-pixels of display panel 304 based upon 6-bit input values. Accordingly, rounding block 614 is configured to receive the 8-bit RGBW gamma corrected luminance values from inverse gamma block 612 and round those values down to 6-bit values that can ultimately be used gate drivers 318 and source drivers 320. When rounding down from 8-bits to 6-bits, however, there can be some rounding error, which rounding block 614 is configured to distribute to the RGBW luminance values of other, nearby sub-pixels in display panel 304. In one embodiment, this error diffusion technique may simply involve rounding down the RBGW luminance values for a first pixel, taking any resulting rounding error and adding to the RGBW luminance values of the next pixel being processed.

The output RGBW values from rounding block 614 are passed into memory controller 526 (see FIG. 5). Memory controller 526 stores the RGBW values for the next frame to be rendered in frame memory 528. When timing controller 316 is ready to render that frame of data, the RGBW data is retrieved from frame memory 528 and used to control one or more of gate drivers 318 and source drivers 320 to set the sub-pixels of display panel 304 to driving voltages corresponding to the RGBW luminance data for the current frame.

Figures 9A, 9B, 9C:
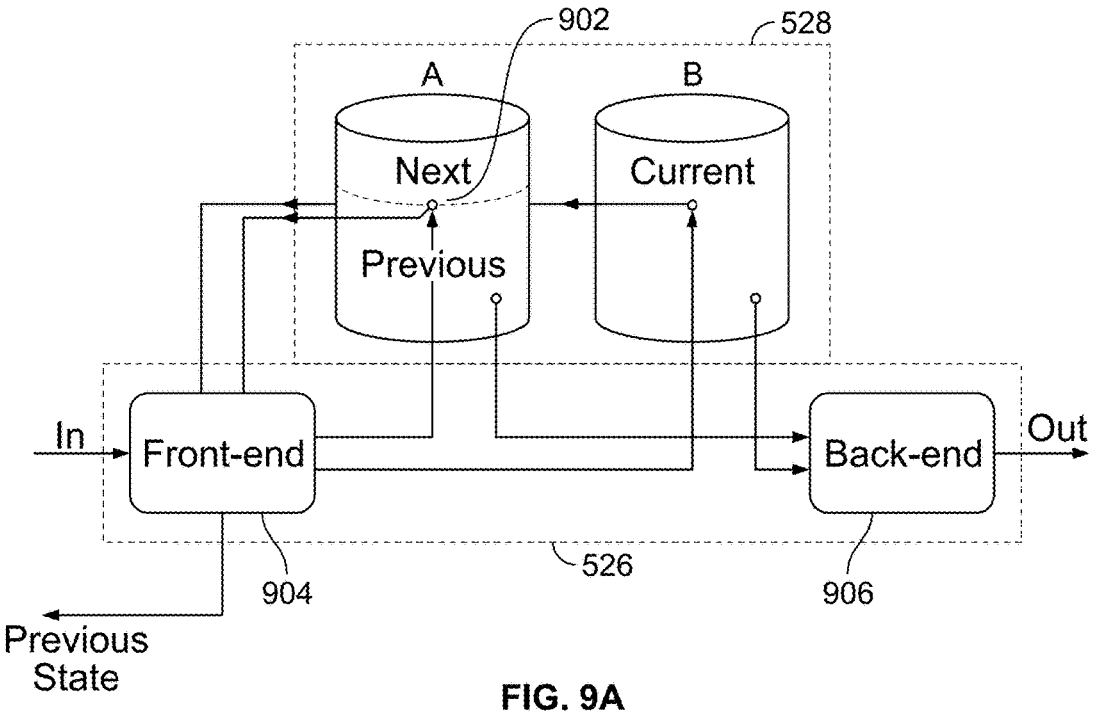
FIG. 9A is a block diagram depicting additional details of a memory controller and a frame memory of the timing controller of FIG. 5.
FIG. 9B is a chart depicting logic rules that control the operation of the front-end interface controller of the memory controller of FIG. 9A.
FIG. 9C is a chart depicting logic rules that control the operation of the back-end interface controller of the memory controller of FIG. 9A.

FIG. 9A is a block diagram depicting additional details of memory controller 526 and frame memory 528.

Frame memory 528 includes two separate frame buffers, referred to as frame buffer A and frame buffer B. Each frame buffer is sized to hold an entire frame of RBGW data for display panel 304—that is RGBW luminance values for each pixel in display panel 304. During operation, one of the frame buffers (e.g., frame buffer A) stores the RGBW data that is currently being used to drive display panel 304.

During that time, new RGBW data is being written into the other frame buffer (e.g., frame buffer B) to be used to drive display panel 304 in the next, upcoming frame. When timing controller 316 is ready to display the next frame of data on display panel 304, frame buffer B becomes the current frame buffer and the RGBW data stored in frame buffer B is used to drive display panel 304. At this time, memory controller 526 begins writing new RGBW data for the next upcoming frame into frame buffer A.

This pattern repeats, with frame buffers A and B swapping status as being the current frame buffer. At the time the status of being the current frame buffers swaps between buffers A and B, the other frame buffer is storing the RGBW data for the previous frame. But the data in that buffer is gradually overwritten with new RGBW data for the upcoming frame.

In the example depicted in FIG. 9A, frame buffer B is the current frame buffer. As such, the RGBW data stored in frame buffer B is being used to drive display panel 304. The RGBW data stored in frame buffer A is mostly for the previous frame that was displayed. But, as illustrated, that data is gradually being overwritten with new RGBW data for the next frame. As new RGBW data is entered into frame buffer A, the pointer in frame buffer A (illustrated by point 902) will move through frame buffer A (as illustrated in FIG. 9A), gradually filling frame buffer A with new RGBW data for the upcoming frame. When buffer A is fully populated with RGBW data for the upcoming next frame, frame buffer A can be designated the current frame buffer and the data stored in frame buffer A can be used to drive display panel 304.

In order to populate frame buffers A and B with RGBW data, memory controller 526 includes front-end interface controller 904. Front-end interface controller 904 receives the RGBW data outputted by rounding block 614 of rendering engine 524. As front-end interface controller 904 receives the RGBW data from rounding block 614, front-end interface controller 904 inserts that data into the frame buffer of frame memory 528 that is storing data for the next, upcoming frame.

Memory controller 526 also includes back-end interface controller 906. Back-end interface controller 906 is configured to retrieve RGBW data values from the current frame buffer. The values, once retrieved, are transmitted to gate drivers 318 and source drivers 320 to cause corresponding driving voltages to be applied to the sub-pixels of display panel 304.

As discussed above, oil movement in a sub-pixel can be unpredictable. This is particularly the case when a previously closed sub-pixel is being opened. If, for example, a previously-closed sub-pixel is set to a luminance value that is only slightly above the threshold luminance value, the driving voltage that corresponds to that luminance value may not be sufficient to promote sufficient oil movement to achieve that desired luminance value promptly. Instead, it may require the application of a driving voltage based on two or more additional frames of display data before sufficient oil movement is observed to achieve the desired luminance value.

To overcome this situation, when driving the sub-pixels of display panel 304, memory controller 526 may be configured to implement a sub-pixel over drive scheme. The over drive scheme involves identify sub-pixels that are being transitioned from a closed state to an open state. For those sub-pixels, before being set to their target luminance level, for a single frame, the sub-pixels can be set to a higher, overdriven luminance value. This overdriven luminance value corresponds to a higher driving voltage. That higher driving voltage will more reliably promote sufficient oil movement to open the sub-pixel. The overdriven luminance value can be applied to the sub-pixel for a single frame to ensure that the sub-pixel has opened. Then, in the next frame, the now open sub-pixel can be reliably set to the desired luminance value retrieved from the current frame buffer for that sub-pixel.

In order to determine whether to overdrive a particular sub-pixel memory controller 526 needs to know the current luminance value assigned to the sub-pixel in the current frame buffer as well as that sub-pixel's prior state. If the frame buffers of frame memory 528 were to only store current and previous RGBW data, memory controller 526 could simply use the sub-pixel's current and previous luminance values retrieved from frame memory 528. If the sub-pixel's prior luminance value was the minimum luminance value (e.g., a luminance value of 0) and the current luminance value is greater than the threshold value (e.g., a luminance value of 20), memory controller 526 could determine that the sub-pixel is being opened and could temporarily overdrive the sub-pixel.

But the frame buffer configuration of frame memory 528 does not only store old and current RGBW data. Although the current frame buffer B (in FIG. 9A frame buffer B is the current frame buffer) reliably stores current luminance data for display panel 304, frame buffer A may store either previous data or data for the next frame, depending upon how much new RGBW data has been loaded into frame buffer A. Additionally, because new luminance data is written to the next frame buffer asynchronously to data being retrieved from the current frame buffer, memory controller 526 cannot be certain whether data retrieved from frame buffer A contains previous or next data for a particular sub-pixel.

Because of this uncertainty, if memory controller 526 were to presume that frame buffer A of FIG. 9A contained only RGBW data for a previous frame and rely on that data in making a determination of whether to overdrive a particular sub-pixel, certain circumstances that call for overdriving a sub-pixel could be missed, resulting in an insufficient number of sub-pixels being overdrive.

For example, assume that in a previous frame a sub-pixel was set to a luminance value of 0. In the current frame, the sub-pixel is set to a luminance value of 22, a value above the threshold luminance value of 20. Such a situation requires that the sub-pixel be overdriven to ensure that the sub-pixel is fully opened. The next luminance value for the sub-pixel is 23.

If the previous luminance value of 0 in frame buffer A has been overwritten with the next luminance value of 23 and memory controller 526 were to presume that frame buffer A only stored previous luminance value, memory controller 526 may see the overwritten value of 23 and incorrectly presume that the sub-pixel is already open, thus requiring no overdrive.

Similarly, assume that in a previous frame a sub-pixel was set to a luminance value of 23. In the current frame, the sub-pixel is set to a luminance value of 22. Such a situation does not require any overdrive because the sub-pixel is already open. The next luminance value for the sub-pixel is 0.

If the previous luminance value of 23 in frame buffer A has been overwritten with the next luminance value of 0 and memory controller 526 were to presume that frame buffer A only stored previous luminance value, memory controller 526 may see the overwritten value of 0 and incorrectly presume that the sub-pixel is currently closed, and that the current luminance value of 22 will cause the sub-pixel to open. In that case, because memory controller 526 believes the sub-pixel to be closed, it would unnecessarily implement overdrive to ensure that the sub-pixel opens.

Accordingly, because the data stored in the frame buffer that is not the current frame buffer is constantly being overwritten with new RGBW data, the buffer cannot be considered to reliably store RGBW luminance data for the previous frame. This can cause necessary overdrive situations to be missed, or overdrive to be used unnecessarily.

To mitigate this problem, front-end interface controller 904 is configured to encode data into frame memory 528 that enables back-end interface controller 906 to implement the overdrive functionality more accurately. Specifically, by analyzing the new luminance data to be stored in the next frame buffer, and by making certain modifications to that data, front-end interface controller 904 can encoded sufficient information within frame memory 528 to ensure that necessary overdrive conditions are not missed by back-end interface controller 906 and that back-end interface controller 906 does not unnecessarily implement overdrive for a particular sub-pixel.

When encoding luminance values into frame memory 528, certain luminance values go unused. As discussed above, due to oil movement behaviors within a sub-pixel, certain luminance values cannot reliably be achieved within a sub-pixel. Quantization, performed by low greyscale rendering block 610 of rendering engine 524 provides that those luminance values go unused. For example, if luminance values can vary from 0 to 63, the values from 1-19 may go unused because they are too difficult to achieve in the sub-pixels of display panel 304 reliably. In the present system, front-end interface controller 904 uses the unused luminance values to encode information enabling back-end interface controller 906 to more intelligently use overdrive.

When storing luminance data in frame memory 528, front-end interface controller 904 is configured to analyze the data being written into frame memory 528. In certain circumstances, front-end interface controller 904 may modify of change the luminance data being written into frame memory 528 to provide that back-end interface controller 906 can more accurately implement an overdrive scheme, as described below.

FIG. 9B is a chart depicting a set of logical rules utilized by front-end interface controller 904 when writing new luminance data into frame memory 528. Conversely, FIG. 9C is a chart depicting a set of logical rules utilized by back-end interface controller 906 when reading luminance data out of frame memory 528. In discussing these logical rule sets, the configuration of frame memory 528 depicted in FIG. 9A will be utilized as an example. As such, frame buffer B is storing current luminance data being used to drive the sub-pixels of display panel 304. Frame buffer A is storing luminance data for the previous frame that was displayed, but front-end interface controller 904 is overwriting that previous frame luminance data with new luminance data for use in rendering the next frame of data to display panel 304.

The logic chart of FIG. 9B includes a first column, addressed, which indicates whether the sub-pixel for which new luminance data is being written as already been addressed by back-end interface controller 906. In this case, addressing a sub-pixel means that back-end interface controller 906 has read the luminance data out of frame memory 528 for that sub-pixel and has instructed source drivers 320 and gate drivers 318 to subject the corresponding sub-pixel with a driving voltage based upon and corresponding to that retrieved luminance data.

The second column describes the previous luminance data for the sub-pixel being processed. The previous data is stored in frame buffer A. The third column describes the current luminance data for the sub-pixel being processed, which is stored in frame buffer B. The input column describes the input luminance data for the sub-pixel received from rounding block 614—this is the new or initial luminance data for the sub-pixel being processed. The table of FIG. 9B also includes two different columns that, based upon the values of the addressed, previous, current, and input columns, specifies how front-end interface controller 904 sets the luminance data stored in both frame buffer A and frame buffer B to be later read out of those frame buffers by back-end interface controller 906.

When writing luminance data to frame memory 528, as described below, front-end interface controller 904 is configured to use a special luminance data value. The data value is equivalent to a minimum luminance value (e.g., a luminance value of 0). Even though the special luminance value is equivalent to a minimum luminance value, back-end interface controller 906, as described below, is configured to treat the special luminance value as a non-zero luminance value when determining whether to overdrive the sub-pixel being processed.

Because a range of luminance values are not used (due to the relative difficult of setting a sub-pixel to low greyscale luminance values), one of the unused luminance values (e.g., '1') can be used to represent the special luminance value described below. In the present disclosure, however, the notation 0* will be used for illustrative purposes. Accordingly, the luminance values 0 and 0* will both represent a minimum luminance value, but will be treated differently by back-end interface controller 906 in determining whether to overdrive particular sub-pixels.

Returning to the table of FIG. 9B, in the first two rows of the table a sub-pixel being processed was previously set to a minimum luminance value 0 and is currently set to a non-zero luminance (i.e., above the threshold luminance value). The input data specifies the new or initial luminance value for the sub-pixel is some value IN.

According to the first row of the logic table, if such a sub-pixel has already been addressed, front-end interface controller 904 will leave the current luminance value (stored in frame buffer B) for the sub-pixel un-changed—the sub-pixel has already been driven with a non-zero luminance value. The next luminance value (stored in frame buffer A) will be set to the input value IN.

If, however, such a sub-pixel has not yet been addressed, the sub-pixel is currently closed (the previous luminance value for the sub-pixel was 0) and the sub-pixel, once addressed, will be opened due to the nonzero value in the current table. Such a sub-pixel requires overdriving. Accordingly, front-end interface controller 904 will set the current luminance value for the sub-pixel to an overdrive level 'overdrive'. This will ensure that the sub-pixel opens when set to the driving voltage that corresponds to the luminance value of overdrive. The sub-pixel will then be open, and the next value for the sub-pixel (stored in frame buffer A) can be set to the input value IN.

The third and fourth rows of the table of FIG. 9B specifies the actions that front-end interface controller 904 will take for sub-pixels that have any previous luminance value, a current luminance value of 0*, and an input of IN.

If such a pixel has been addressed, the sub-pixel has been closed (because the sub-pixel has been set to a minimum luminance value). As such, the sub-pixel's current luminance value is set to 0. The next luminance value for the sub-pixel is set to the input IN. According to the fourth row of the table, front-end interface controller 904 will take the same actions even if the sub-pixel has not yet been addressed.

The fifth and sixth rows of the table of FIG. 9B specify the actions that front-end interface controller 904 will take for sub-pixels that have non-zero (i.e., non-minimum luminance values) for the previous and current luminance values and an input luminance value of 0.

If such a sub-pixel has already been addressed, front-end interface controller 904 will not change the sub-pixel's current luminance value and will set the new luminance value for the sub-pixel to a value of 0. If, however, the sub-pixel has not yet been addressed, and a simple minimum luminance value of 0 were to be written into frame buffer A as the sub-pixel's next luminance value, when the sub-pixel is ultimately addressed, back-end interface controller 906 could interpret that value of 0 in frame buffer A to mean that the sub-pixel was previously closed, resulting in an incorrect overdrive condition. As such, in this example, rather than write the value 0 as the sub-pixel next luminance value into frame buffer A, front-end interface controller 904 is configured to write the value 0*. Although the value 0* represents a minimum luminance value, as described below, that value helps back-end interface controller 906 avoid an unnecessary overdrive condition.

Turning to FIG. 9C, a logic chart is depicted illustrated how back-end interface controller 906 reads luminance data out of frame memory 528 and uses that luminance data to establish a drive scheme for the sub-pixel being processed. When processing luminance data for a particular sub-pixel, back-end interface controller 906 will read the sub-pixel's luminance data in the current frame buffer (e.g., frame buffer B) as well as that sub-pixel's luminance data from the previous (and possibly next) frame buffer (e.g., frame buffer A). Depending upon the retrieved vales, back-end interface controller 906 will transmit particular luminance values to gate driver 318 and/or source driver 320 to cause those drivers to subject the sub-pixel to a driving voltage that corresponds to the luminance values transmitted by back-end interface controller 906.

Referring to the table of FIG. 9C, if, for a particular sub-pixel, the sub-pixel's luminance data stored in the previous/next frame buffer (e.g., frame buffer A) is the minimum luminance value 0 and the luminance value stored in the current frame buffer (e.g., frame buffer B) is a nonzero value, that combination indicates an overdrive condition is necessary. The minimum luminance value stored in frame buffer A indicates that the sub-pixel is currently closed and the non-zero value stored in frame buffer B indicates that the sub-pixel will be opened. Accordingly, back-end interface controller 906 causes the sub-pixel to be overdriven by outputting an overdrive luminance value that corresponding to an over drive driving voltage.

The second row specifies the actions that back-end interface controller 906 will take for sub-pixels that have a non-zero luminance value stored in the previous/next frame buffer A and a non-zero luminance value stored in the current frame buffer B. In that case, the previous/next data indicates that the sub-pixel is currently in an open state. As such, the sub-pixel can be driven to the non-zero luminance value stored in the current frame buffer B without any overdrive. Accordingly, back-end interface controller 906 causes the sub-pixel to be driven with the non-zero luminance value stored in the current frame buffer B.

The third row specifies the actions that back-end interface controller 906 will take for sub-pixels that have a current luminance value stored in frame buffer B of 0*. In such a case, the luminance value stored in the previous/next frame buffer A is irrelevant. Because the current value is set to 0* (which is equivalent to a minimum luminance value), the sub-pixel can safely be driven to a minimum luminance value. Even if the sub-pixel is already open, minimum luminance levels can be outputted with no overdrive.

The fourth row specifies the actions that back-end interface controller 906 will take for sub-pixels that have a luminance value in the previous/next frame buffer A of 0* and a current luminance in frame buffer B that is non-zero. Typically, such a situation would indicate that overdrive is necessary—the sub-pixel appears to be in a minimum luminance state (e.g., closed) and the sub-pixel is going to be opened due to the nonzero value in the current frame buffer B. Here, however, because the value stored in the previous/next frame buffer A is the special state 0*, back-end interface controller 906 does not undertake any overdrive action. The special state 0*, although correlating to a minimum luminance value is used to signal to back-end interface controller 906 that no overdrive is necessary. This may indicate, for example, that the luminance data stored in frame buffer A is actually an overwritten value and so, rather than representing the current state of the sub-pixel, indicates the next luminance value that will be applied to the sub-pixel after the current luminance value.

In this configuration, the overdrive luminance values may be predetermined luminance. The value may be determined based upon attributes of the display panel of the display device, or the attributes of other components of the display device. The value may be selected so as to minimize the likelihood of oil breakage, and thereby visual artifacts. Or, alternatively, the value may be selected to minimize power consumption within the display device.

Generally, back-end interface controller 906 operates by transmitting a luminance value, as determined by the logic chart of FIG. 9C to one or both of gate drivers 318 and source drivers 320. The drivers, in turn, convert the receive luminance value into a corresponding driving voltage. With the driving voltage determined, the drivers subject the corresponding sub-pixel within display panel 304 to the driving voltage to cause oil movement within the sub-pixel.

In this configuration of memory controller 526, the process of reading data out of frame buffer 528 does not have to occur synchronously with the writing of new data into frame buffer 528. As such, the writing of data into frame buffer 528 and the reading of data out of frame buffer 528 can occur asynchronously. If new data is not supplied into frame buffer 528 via front-end interface controller 904, back-end interface controller 906 can continue reading data out of frame buffer 528 and will continue displaying information on the connected display panel 304. This operation does not, therefore, require a constant stream of new image data to enable images to be rendered on display panel 304. Consequently, host processor 302 (see FIG. 3) is not required to continuously generate new image data.

Host processor 302 may, therefore, be enabled to sleep (reducing power consumption of host processor 302) and image data will continue to be display on display panel 304. This can be useful, for example, if the information being displayed on display panel 304 is static (e.g., e-reader text content). While the image data is static, host processor 302 can sleep, and the current page of text being display can continue to be rendered on display panel 304 by memory controller 526. When a user takes an action that causes the text to be display to be updated, host processor 302 can wake up, generate new image data depicting the updated text content and then go back to sleep. The new image data will be rendered to display panel 304 by memory controller 526.

Figure 10:
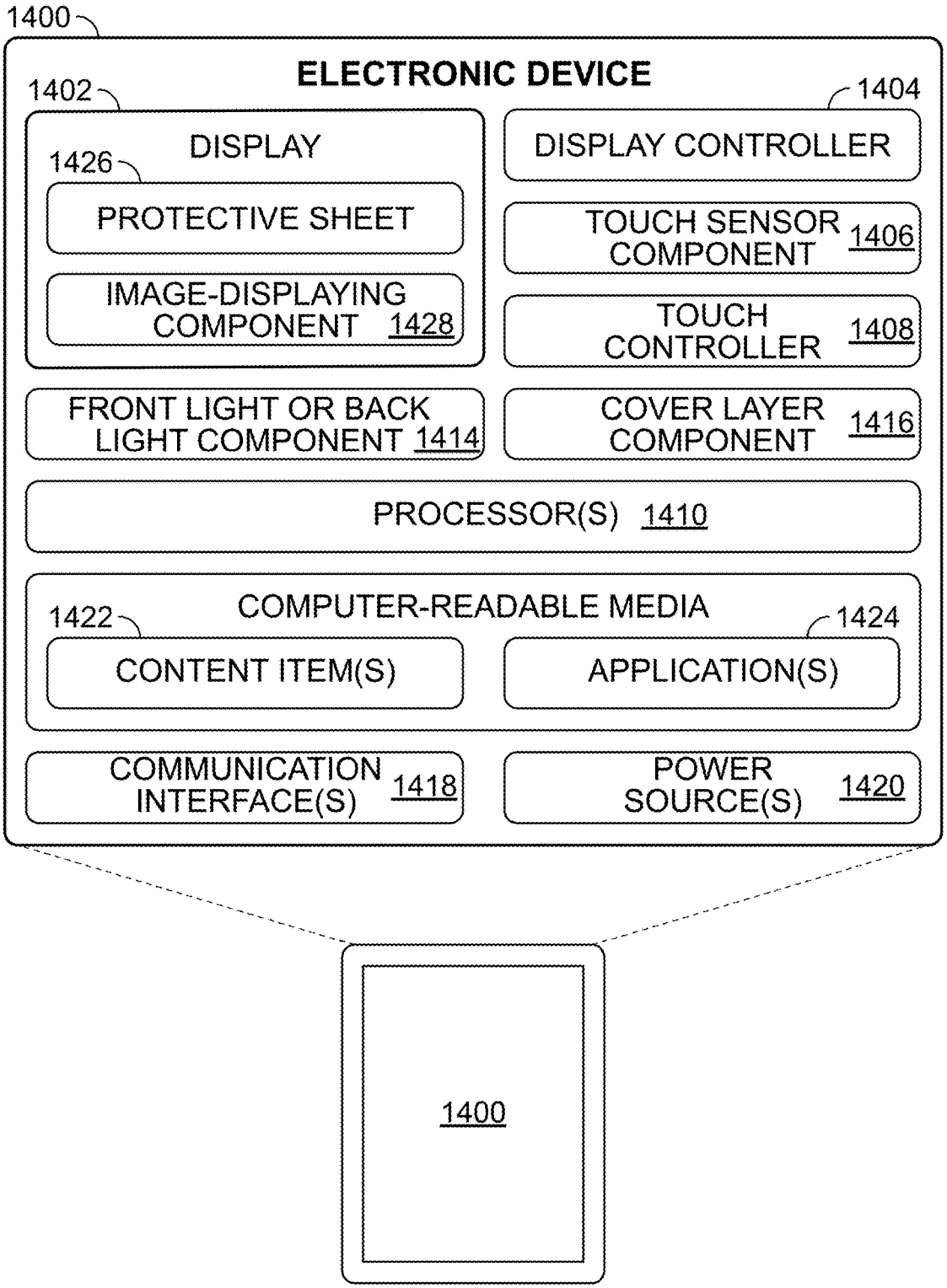
FIG. 10 illustrates an example electronic device that may incorporate a display device, according to various embodiments.

FIG. 10 illustrates an example electronic device 1400 that may incorporate any of the display devices discussed above. Electronic device 1400 may comprise any type of electronic device having a display. For instance, electronic device 1400 may be a mobile electronic device (e.g., an electronic book reader, a tablet computing device, a laptop computer, a smart phone or other multifunction communication device, a portable digital assistant, a wearable computing device, or an automotive display). Alternatively, electronic device 1400 may be a non-mobile electronic device (e.g., a computer display or a television). In addition, while FIG. 14 illustrates several example components of electronic device 1400, it is to be appreciated that electronic device 1400 may also include other conventional components, such as an operating system, system busses, input/output components, and the like. Further, in other embodiments, such as in the case of a television or computer monitor, electronic device 1400 may only include a subset of the components illustrated.

Regardless of the specific implementation of electronic device 1400, electronic device 1400 includes a display 1402 and a corresponding display controller 1404. The display 1402 may represent a reflective or transmissive display in some instances or, alternatively, a transflective display (partially transmissive and partially reflective).

In one embodiment, display 1402 comprises an electrowetting display that employs an applied voltage to change the surface tension of a fluid in relation to a surface. For example, such an electrowetting display may include the array of sub-pixels 100 illustrated in FIG. 1, though claimed subject matter is not limited in this respect. By applying a voltage across a portion of an electrowetting pixel of an electrowetting display, wetting properties of a surface may be modified so that the surface becomes increasingly hydrophilic. As one example of an electrowetting display, the modification of the surface tension acts as an optical switch by displacing a colored oil film if a voltage is applied to individual pixels of the display. If the voltage is absent, the colored oil forms a continuous film within a pixel, and the color may thus be visible to a user. On the other hand, if the voltage is applied to the sub-pixel, the colored oil is displaced and the sub-pixel becomes transparent. If multiple sub-pixels of the display are independently activated, display 1402 may present a color or grayscale image. The sub-pixels may form the basis for a transmissive, reflective, or transmissive/reflective (transreflective) display. Further, the sub-pixels may be responsive to high switching speeds (e.g., on the order of several milliseconds), while employing small sub-pixel dimensions. Accordingly, the electrowetting displays herein may be suitable for applications such as displaying video or other animated content.

Of course, while several different examples have been given, it is to be appreciated that while some of the examples described above are discussed as rendering black, white, and varying shades of gray, it is to be appreciated that the described techniques apply equally to reflective displays capable of rendering color pixels. As such, the terms "white," "gray," and "black" may refer to varying degrees of color in implementations utilizing color displays. For instance, where a pixel includes a red color filter, a "gray" value of the pixel may correspond to a shade of pink while a "black" value of the pixel may correspond to a darkest red of the color filter. Furthermore, while some examples herein are described in the environment of a reflective display, in other examples, display 1402 may represent a backlit display, examples of which are mentioned above.

In addition to including display 1402, FIG. 14 illustrates that some examples of electronic device 1400 may include a touch sensor component 1406 and a touch controller 1408. In some instances, at least one touch sensor component 1406 resides with, or is stacked on, display 1402 to form a touch-sensitive display. Thus, display 1402 may be capable of both accepting user touch input and rendering content in response to or corresponding to the touch input. As several examples, touch sensor component 1406 may comprise a capacitive touch sensor, a force sensitive resistance (FSR), an interpolating force sensitive resistance (IFSR) sensor, or any other type of touch sensor. In some instances, touch sensor component 1406 is capable of detecting touches as well as determining an amount of pressure or force of these touches.

FIG. 14 further illustrates that electronic device 1400 may include one or more processors 1410 and one or more computer-readable media 1412, as well as a front light component 1414 (which may alternatively be a backlight component in the case of a backlit display) for lighting display 1402, a cover layer component 1416, such as a cover glass or cover sheet, one or more communication interfaces 1418 and one or more power sources 1420. The communication interfaces 1418 may support both wired and wireless connection to various networks, such as cellular networks, radio, WiFi networks, short range networks (e.g., Bluetooth® technology), and infrared (IR) networks, for example.

Depending on the configuration of electronic device 1400, computer-readable media 1412 (and other computer-readable media described throughout) is an example of computer storage media and may include volatile and nonvolatile memory. Thus, computer-readable media 1412 may include, without limitation, RAM, ROM, EEPROM, flash memory, and/or other memory technology, and/or any other suitable medium that may be used to store computer-readable instructions, programs, applications, media items, and/or data which may be accessed by electronic device 1400.

Computer-readable media 1412 may be used to store any number of functional components that are executable on processor 1410, as well as content items 1422 and applications 1424. Thus, computer-readable media 1412 may include an operating system and a storage database to store one or more content items 1422, such as eBooks, audio books, songs, videos, still images, and the like. Computer-readable media 1412 of electronic device 1400 may also store one or more content presentation applications to render content items on electronic device 1400. These content presentation applications may be implemented as various applications 1424 depending upon content items 1422. For instance, the content presentation application may be an electronic book reader application for rending textual electronic books, an audio player for playing audio books or songs, or a video player for playing video.

In some instances, electronic device 1400 may couple to a cover (not illustrated in FIG. 14) to protect the display 1402 (and other components in the display stack or display assembly) of electronic device 1400. In one example, the cover may include a back flap that covers a back portion of electronic device 1400 and a front flap that covers display 1402 and the other components in the stack. Electronic device 1400 and/or the cover may include a sensor (e.g., a Hall effect sensor) to detect whether the cover is open (i.e., if the front flap is not atop display 1402 and other components). The sensor may send a signal to front light component 1414 if the cover is open and, in response, front light component 1414 may illuminate display 1402. If the cover is closed, meanwhile, front light component 1414 may receive a signal indicating that the cover has closed and, in response, front light component 1414 may turn off.

Furthermore, the amount of light emitted by front light component 1414 may vary. For instance, upon a user opening the cover, the light from the front light may gradually increase to its full illumination. In some instances, electronic device 1400 includes an ambient light sensor (not illustrated in FIG. 14) and the amount of illumination of front light component 1414 may be based at least in part on the amount of ambient light detected by the ambient light sensor. For example, front light component 1414 may be dimmer if the ambient light sensor detects relatively little ambient light, such as in a dark room; may be brighter if the ambient light sensor detects ambient light within a particular range; and may be dimmer or turned off if the ambient light sensor detects a relatively large amount of ambient light, such as direct sunlight.

In addition, the settings of display 1402 may vary depending on whether front light component 1414 is on or off, or based on the amount of light provided by front light component 1414. For instance, electronic device 1400 may implement a larger default font or a greater contrast when the light is off compared to when the light is on. In some embodiments, electronic device 1400 maintains, if the light is on, a contrast ratio for display 1402 that is within a certain defined percentage of the contrast ratio if the light is off.

As described above, touch sensor component 1406 may comprise a capacitive touch sensor that resides atop display 1402. In some examples, touch sensor component 1406 may be formed on or integrated with cover layer component 1416. In other examples, touch sensor component 1406 may be a separate component in the stack of the display assembly. Front light component 1414 may reside atop or below touch sensor component 1406. In some instances, either touch sensor component 1406 or front light component 1414 is coupled to a top surface of a protective sheet 1426 of display 1402. As one example, front light component 1414 may include a lightguide sheet and a light source (not illustrated in FIG. 14). The lightguide sheet may comprise a substrate (e.g., a transparent thermoplastic such as PMMA or other acrylic), a layer of lacquer and multiple grating elements formed in the layer of lacquer that function to propagate light from the light source towards display 1402; thus, illuminating display 1402.

Cover layer component 1416 may include a transparent substrate or sheet having an outer layer that functions to reduce at least one of glare or reflection of ambient light incident on electronic device 1400. In some instances, cover layer component 1416 may comprise a hard-coated polyester and/or polycarbonate film, including a base polyester or a polycarbonate, that results in a chemically bonded UV-cured hard surface coating that is scratch resistant. In some instances, the film may be manufactured with additives such that the resulting film includes a hardness rating that is greater than a predefined threshold (e.g., at least a hardness rating that is resistant to a 3h pencil). Without such scratch resistance, a device may be more easily scratched and a user may perceive the scratches from the light that is dispersed over the top of the reflective display. In some examples, protective sheet 1426 may include a similar UV-cured hard coating on the outer surface. Cover layer component 1416 may couple to another component or to protective sheet 1426 of display 1402. Cover layer component 1416 may, in some instances, also include a UV filter, a UV-absorbing dye, or the like, for protecting components lower in the stack from UV light incident on electronic device 1400. In still other examples, cover layer component 1416 may include a sheet of high-strength glass having an antiglare and/or antireflective coating.

Display 1402 includes protective sheet 1426 overlying an image-displaying component 1428. For example, display 1402 may be preassembled to have protective sheet 1426 as an outer surface on the upper or image-viewing side of display 1402. Accordingly, protective sheet 1426 may be integral with and may overlay image-displaying component 1428. Protective sheet 1426 may be optically transparent to enable a user to view, through protective sheet 1426, an image presented on image-displaying component 1428 of display 1402.

In some examples, protective sheet 1426 may be a transparent polymer film in the range of 25 to 200 micrometers in thickness. As several examples, protective sheet 1426 may be a transparent polyester, such as polyethylene terephthalate (PET) or polyethylene naphthalate (PEN), or other suitable transparent polymer film or sheet, such as a polycarbonate or an acrylic. In some examples, the outer surface of protective sheet 1426 may include a coating, such as the hard coating described above. For instance, the hard coating may be applied to the outer surface of protective sheet 1426 before or after assembly of protective sheet 1426 with image-displaying component 1428 of display 1402. In some examples, the hard coating may include a photoinitiator or other reactive species in its composition, such as for curing the hard coating on protective sheet 1426. Furthermore, in some examples, protective sheet 1426 may be dyed with a UV-light-absorbing dye, or may be treated with other UV-absorbing treatment. For example, protective sheet 1426 may be treated to have a specified UV cutoff such that UV light below a cutoff or threshold wavelength is at least partially absorbed by protective sheet 1426, thereby protecting image-displaying component 1428 from UV light.

According to some embodiments herein, one or more of the components discussed above may be coupled to display 1402 using fluid optically-clear adhesive (LOCA). For example, the lightguide portion of front light component 1414 may be coupled to display 1402 by placing LOCA on the outer or upper surface of protective sheet 1426. If the LOCA reaches the corner(s) and/or at least a portion of the perimeter of protective sheet 1426, UV-curing may be performed on the LOCA at the corners and/or the portion of the perimeter. Thereafter, the remaining LOCA may be UV-cured and front light component 1414 may be coupled to the LOCA. By first curing the corner(s) and/or the perimeter, the techniques effectively create a barrier for the remaining LOCA and also prevent the formation of air gaps in the LOCA layer, thereby increasing the efficacy of front light component 1414. In other embodiments, the LOCA may be placed near a center of protective sheet 1426, and pressed outwards towards a perimeter of the top surface of protective sheet 1426 by placing front light component 1414 on top of the LOCA. The LOCA may then be cured by directing UV light through front light component 1414. As discussed above, and as discussed additionally below, various techniques, such as surface treatment of the protective sheet, may be used to prevent discoloration of the LOCA and/or protective sheet 1426.

While FIG. 14 illustrates a few example components, electronic device 1400 may have additional features or functionality. For example, electronic device 1400 may also include additional data storage devices (removable and/or non-removable) such as, for example, magnetic disks, optical disks, or tape. The additional data storage media, which may reside in a control board, may include volatile and nonvolatile, removable and non-removable media implemented in any method or technology for storage of information, such as computer readable instructions, data structures, program modules, or other data. In addition, some or all of the functionality described as residing within electronic device 1400 may reside remotely from electronic device 1400 in some implementations. In these implementations, electronic device 1400 may utilize communication interfaces 1418 to communicate with and utilize this functionality.

In an embodiment, an electrowetting display device includes a first support plate and a second support plate opposite the first support plate, and a plurality of pixels positioned between the first support plate and the second support plate and arranged in a grid having a plurality of rows and a plurality of columns. The electrowetting display device includes a row driver to provide first addressing signals to the plurality of rows, a column driver to provide second addressing signals to the plurality of columns, and a host processor configured to output image data. The electrowetting display device includes a packaged integrated circuit that includes an input signal pin electrically connected to the host processor, a first output signal pin electrically connected to the row driver, a second output signal pin electrically connected to the column driver, a settings register configured to store image processing parameters, and a serial input interface electrically connected to the input signal pin. The serial input interface is configured to receive the image data from the host processor through the input signal pin. The packaged integrated circuit includes a rendering engine configured to receive the image data from the serial input interface, receive an image processing parameter from the settings register, and generate a luminance value for a first pixel in the plurality of pixels using the image data and the image processing parameter. The packaged integrated circuit includes a memory controller configured to receive the luminance value for the first pixel, and transmit a first data signal through the first output signal pin to the row driver and a second data signal through the second output signal pin to the column driver to cause the row driver and the column driver to apply a driving voltage to the first pixel in the plurality of pixels. The driving voltage is at least partially determined by the luminance value.

In an embodiment, an electrowetting display device includes a plurality of pixels positioned between a first support plate and a second support plate and a display driver to provide addressing signals to the plurality of pixels. The electrowetting display device includes a packaged integrated circuit that includes an input pin configured to electrically connected to a host processor, an output pin electrically connected to the display driver, and an input interface configured to receive image data from a host processor through the input pin. The packaged integrated circuit includes a rendering engine configured to generate a luminance value for a first pixel in the plurality of pixels using the image data, and a memory controller configured transmit a data signal through the output pin to cause the display driver to apply a driving voltage to the first pixel in the plurality of pixels. The driving voltage is at least partially determined by the luminance value.

In an embodiment, a packaged integrated circuit includes an input pin configured to receive image data. The image data includes a video value in an RGB color space. The packaged integrated circuit includes an output pin configured to be electrically connected to a display driver, a rendering engine configured to generate a luminance value in an RGBW color space using the image data, and a memory controller configured to transmit a data signal through the output pin to cause the display driver apply a driving voltage to a pixel of a display. The data signal is at least partially determined by the luminance value.

In an embodiment, an electrowetting display device includes a first support plate and a second support plate opposite the first support plate and a plurality of pixels positioned between the first support plate and the second support plate and arranged in a grid having a plurality of rows and a plurality of columns. The electrowetting display device includes a row driver to provide first addressing signals to the plurality of rows, a column driver to provide second addressing signals to the plurality of columns, and a host processor configured to output image data. The electrowetting display device includes a packaged integrated circuit that includes an input signal pin electrically connected to the host processor, a first output signal pin electrically connected to the row driver, a second output signal pin electrically connected to the column driver, a settings register configured to store image processing parameters, and a serial input interface electrically connected to the input signal pin. The serial input interface is configured to receive the image data from the host processor through the input signal pin. The image data includes a red value, a green value, and a blue value. The packaged integrated circuit includes a rendering engine configured to receive the red value, the green value and the blue value from the serial input interface, and convert the red value, the green value, and the blue value into a red luminance value, a green luminance value, a blue luminance value, and a white luminance value for a first pixel in the plurality of pixels. The packaged integrated circuit includes a memory controller configured to receive the red luminance value, the green luminance value, the blue luminance value, and the white luminance value for the first pixel, and transmit a first data signal through the first output signal pin to the row driver and a second data signal through the second output signal pin to the column driver to cause the row driver and the column driver to apply a driving voltage to the first pixel in the plurality of pixels. The driving voltage is at least partially determined by one of the red luminance value, the green luminance value, the blue luminance value, and the white luminance value for the first pixel.

In an embodiment, a packaged integrated circuit includes an input signal pin configured to electrically connect to a host processor, a first output signal pin configured to electrically connect to a first display driver, a second output signal pin configured to electrically connect to a second display driver, and a first interface configured to receive image data from the host processor through the input signal pin. The image data includes a first red value, a first green value, and a first blue value for a first location in the image data. The packaged integrated circuit includes an integrated circuit configured to implement a rendering engine. The rendering engine is configured to receive the image data from the first interface, and convert the first red value, the first green value, and the first blue value into a first red luminance value, a first green luminance value, a first blue luminance value, and a first white luminance value for a first pixel in a plurality of pixels. The packaged integrated circuit includes a memory controller configured to receive the first red luminance value, the first green luminance value, the first blue luminance value, and the first white luminance value for the first pixel, and transmit a first data signal through the first output signal pin to the first display driver and a second data signal through the second output signal pin to the second display driver to cause the first display driver and the second display driver to apply a driving voltage to a sub-pixel of the first pixel. The driving voltage is at least partially determined by one of the first red luminance value, the first green luminance value, the first blue luminance value, and the first white luminance value for the first pixel.

In an embodiment, a packaged integrated circuit includes an input pin configured to electrically connect to a host processor, an output pin configured to electrically connect to a display driver, and a memory controller configured to store luminance values. The packaged integrated circuit includes an integrated circuit configured to implement a rendering engine. The rendering engine is configured to receive a first red value, a first green value, and a first blue value from the input pin, convert the first red value, the first green value, and the first blue value into a first red luminance value, a first green luminance value, a first blue luminance value, and a first white luminance value for a first pixel in a plurality of pixels, and transmit the first red luminance value, the first green luminance value, the first blue luminance value, and the first white luminance value to the memory controller.

In an embodiment, an electrowetting display device includes a first support plate and a second support plate opposite the first support plate and a plurality of pixels positioned between the first support plate and the second support plate and arranged in a grid having a plurality of rows and a plurality of columns. The electrowetting display device includes a row driver to provide addressing signals to the plurality of rows, a column driver to provide addressing signals to the plurality of columns, and a host processor configured to output image data. The electrowetting display device includes a packaged integrated circuit that includes an input signal pin electrically connected to the host processor, a first output signal pin electrically connected to the row driver, a second output signal pin electrically connected to the column driver, and a rendering engine configured to receive the image data from the host processor through the input signal pin and output an initial luminance value for a first pixel in the plurality of pixels based on the image data. The packaged integrated circuit includes a memory controller that includes a first frame buffer storing a current luminance value for the first pixel, a second frame buffer, and a front-end interface controller configured to receive the initial luminance value for the first pixel, and encode a next luminance value for the first pixel into the second frame buffer, the next luminance value being at least partially determined by the initial luminance value for the first pixel. The memory controller includes a back-end interface controller configured to retrieve the current luminance value for the first pixel, and transmit a first data signal through the first output signal pin to the row driver and a second data signal through the second output signal pin to the column driver to cause the row driver and the column driver to apply a driving voltage to the first pixel. The driving voltage is at least partially determined by the current luminance value.

In an embodiment, a packaged integrated includes an output pin configured to electrically connect to a display driver, a rendering engine configured to output an initial luminance value for a first pixel in a plurality of pixels, and a memory controller. The memory controller includes a first frame buffer storing a current luminance value for the first pixel, a second frame buffer, and a front-end interface controller configured to encode a next luminance value for the first pixel into the second frame buffer. The next luminance value is at least partially determined by the initial luminance value for the first pixel. The memory controller includes a back-end interface controller configured to transmit a data signal through the output pin to the display driver to cause the display driver to apply a driving voltage to the first pixel. The driving voltage is at least partially determined by the current luminance value.

In an embodiment, a device includes an output pin configured to electrically connect to a display driver, a first frame buffer storing a current luminance value for a first pixel in a plurality of pixels and a second frame buffer. The device includes a controller configured to determine an initial luminance value for the first pixel, and encode a next luminance value for the first pixel into the second frame buffer. The next luminance value is at least partially determined by the initial luminance value for the first pixel. The controller is configured to transmit a data signal through the output pin to the display driver to cause the display driver to apply a driving voltage to the first pixel. The driving voltage is at least partially determined by the current luminance value.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

Reference throughout this specification to "one embodiment" or "an embodiment" may mean that a particular feature, structure, or characteristic described in connection with a particular embodiment may be included in at least one embodiment of claimed subject matter. Thus, appearances of the phrase "in one embodiment" or "an embodiment" in various places throughout this specification is not necessarily intended to refer to the same embodiment or to any one particular embodiment described. Furthermore, it is to be understood that particular features, structures, or characteristics described may be combined in various ways in one or more embodiments. In general, of course, these and other issues may vary with the particular context of usage. Therefore, the particular context of the description or the usage of these terms may provide helpful guidance regarding inferences to be drawn for that context.

What is claimed is:

1. An electrowetting display device, comprising:

a first support plate and a second support plate opposite the first support plate;

a plurality of pixels positioned between the first support plate and the second support plate and arranged in a grid having a plurality of rows and a plurality of columns;

a row driver to provide addressing signals to the plurality of rows;

a column driver to provide addressing signals to the plurality of columns;

a host processor configured to output image data; and a packaged integrated circuit, including:

an input signal pin electrically connected to the host processor, a first output signal pin electrically connected to the row driver, a second output signal pin electrically connected to the column driver, a rendering engine configured to receive the image data from the host processor through the input signal pin, and output an initial luminance value for a first pixel in the plurality of pixels based on the image data, and a memory controller, including:

a first frame buffer storing a current luminance value for the first pixel, a second frame buffer, a front-end interface controller configured to:

receive the initial luminance value for the first pixel, and encode a next luminance value for the first pixel into the second frame buffer, the next luminance value being at least partially determined by the initial luminance value for the first pixel, and a back-end interface controller configured to:

retrieve the current luminance value for the first pixel, and transmit a first data signal through the first output signal pin to the row driver and a second data signal through the second output signal pin to the column driver to cause the row driver and the column driver to apply a driving voltage to the first pixel, wherein the driving voltage is at least partially determined by the current luminance value.

2. The electrowetting display device of claim 1, wherein the front-end interface controller of the memory controller is configured to, before encoding the next luminance value for the first pixel into the second frame buffer:

retrieve a previous luminance value for the first pixel from the second frame buffer;

determine that the previous luminance value is equal to a minimum luminance value and the initial luminance value is greater than the minimum luminance value; and set the next luminance value to an overdrive luminance value.

3. The electrowetting display device of claim 1, wherein the back-end interface controller is configured to:

retrieve a previous luminance value for the first pixel from the second frame buffer;

determine that the previous luminance value is a first value corresponding to a minimum luminance value and the current luminance value is greater than the minimum luminance value; and cause the row driver and the column driver to apply a driving voltage to the first pixel in the plurality of pixels, wherein the driving voltage corresponds to an overdrive luminance value.

4. The electrowetting display device of claim 3, wherein the back-end interface controller is configured to:

retrieve a previous luminance value for the first pixel from the second frame buffer;

determine that the previous luminance value is a second value corresponding to the minimum luminance value and the current luminance value is greater than the minimum luminance value, wherein the second value corresponding to the minimum luminance value is different from the first value corresponding to the minimum luminance value; and cause the row driver and the column driver to apply a driving voltage to the first pixel in the plurality of pixels, wherein the driving voltage corresponds to the current luminance value for the pixel.

5. A packaged integrated circuit, comprising:

an output pin configured to electrically connect to a display driver;

a rendering engine configured to output an initial luminance value for a first pixel in a plurality of pixels; and a memory controller, including:

a first frame buffer storing a current luminance value for the first pixel, a second frame buffer, a front-end interface controller configured to encode a next luminance value for the first pixel into the second frame buffer, the next luminance value being at least partially determined by the initial luminance value for the first pixel, and a back-end interface controller configured to transmit a data signal through the output pin to the display driver to cause the display driver to apply a driving voltage to the first pixel, wherein the driving voltage is at least partially determined by the current luminance value.

6. The packaged integrated circuit of claim 5, wherein the front-end interface controller of the memory controller is configured to, before encoding the next luminance value for the first pixel into the second frame buffer:

retrieve a previous luminance value for the first pixel from the second frame buffer;

determine that the previous luminance value is equal to a minimum luminance value and the initial luminance value is greater than the minimum luminance value; and set the next luminance value to an overdrive luminance value.

7. The packaged integrated circuit of claim 5, wherein the front-end interface controller of the memory controller is configured to, before encoding the next luminance value for the first pixel into the second frame buffer:

retrieve a previous luminance value for the first pixel from the second frame buffer;

determine that the previous luminance value is greater than a minimum luminance value and the initial luminance value is the minimum luminance value; and set the next luminance value equal to the minimum luminance value.

8. The packaged integrated circuit of claim 7, wherein the front-end interface controller is configured to:

determine that the first pixel is set to a driving voltage determined by the current luminance value; and set the next luminance value equal to the minimum luminance value by setting the next luminance value to a first luminance value corresponding to the minimum luminance value.

9. The packaged integrated circuit of claim 8, wherein the front-end interface controller is configured to:

determine that the first pixel is not set to a driving voltage determined by the current luminance value; and set the next luminance value equal to the minimum luminance value by setting the next luminance value equal to a second luminance value corresponding to the minimum luminance value, the second luminance value being different from the first luminance value.

10. The packaged integrated circuit of claim 5, wherein the back-end interface controller is configured to:

retrieve a previous luminance value for the first pixel from the second frame buffer;

determine that the previous luminance value is a first value corresponding to a minimum luminance value and the current luminance value is greater than the minimum luminance value; and cause the display driver to apply a driving voltage to the first pixel in the plurality of pixels, wherein the driving voltage corresponds to an overdrive luminance value.

11. The packaged integrated circuit of claim 10, wherein the back-end interface controller is configured to:

retrieve a previous luminance value for the first pixel from the second frame buffer;

determine that the previous luminance value is a second value corresponding to the minimum luminance value and the current luminance value is greater than the minimum luminance value; and cause the display driver to apply a second driving voltage to the first pixel in the plurality of pixels, wherein the second driving voltage corresponds to the current luminance value for the pixel.

12. The packaged integrated circuit of claim 5, wherein the front-end interface controller is configured to, before encoding the next luminance value for the first pixel into the second frame buffer:

retrieve a previous luminance value for the first pixel from the second frame buffer; and transmit the previous luminance value to the rendering engine.

13. The packaged integrated circuit of claim 5, wherein the packaged integrated circuit is implemented as a wafer level chip scale package.

14. A device, comprising:

an output pin configured to electrically connect to a display driver;

a first frame buffer storing a current luminance value for a first pixel in a plurality of pixels;

a second frame buffer; and a controller configured to:

determine an initial luminance value for the first pixel, encode a next luminance value for the first pixel into the second frame buffer, the next luminance value being at least partially determined by the initial luminance value for the first pixel, and transmit a data signal through the output pin to the display driver to cause the display driver to apply a driving voltage to the first pixel, wherein the driving voltage is at least partially determined by the current luminance value.

15. The device of claim 14, wherein the controller is configured to, before encoding the next luminance value for the first pixel into the second frame buffer:

retrieve a previous luminance value for the first pixel from the second frame buffer;

determine that the previous luminance value is equal to a minimum luminance value and the initial luminance value is greater than the minimum luminance value; and set the next luminance value to an overdrive luminance value.

16. The device of claim 14, wherein the controller is configured to, before encoding the next luminance value for the first pixel into the second frame buffer:

retrieve a previous luminance value for the first pixel from the second frame buffer;

determine that the previous luminance value is greater than a minimum luminance value and the initial luminance value is the minimum luminance value; and set the next luminance value equal to the minimum luminance value.

17. The device claim 16, wherein the controller is configured to:

determine that the first pixel is set to a driving voltage determined by the current luminance value; and set the next luminance value equal to the minimum luminance value by setting the next luminance value to a first luminance value corresponding to the minimum luminance value.

18. The device claim 17, wherein the controller is configured to:

determine that the first pixel is not set to a driving voltage determined by the current luminance value; and set the next luminance value equal to a second luminance value corresponding to the minimum luminance value, the second luminance value being different from the first luminance value.

19. The device claim 14, wherein the controller is configured to:

retrieve a previous luminance value for the first pixel from the second frame buffer;

determine that the previous luminance value is a first value corresponding to a minimum luminance value and the current luminance value is greater than the minimum luminance value; and cause the display driver to apply a driving voltage to the first pixel in the plurality of pixels, wherein the driving voltage is determined by an overdrive luminance value.

20. The device of claim 19, wherein the controller is configured to:

retrieve a previous luminance value for the first pixel from the second frame buffer;

determine that the previous luminance value is a second value corresponding to the minimum luminance value and the current luminance value is greater than the minimum luminance value; and cause the display driver to apply a second driving voltage to the first pixel in the plurality of pixels, wherein the second driving voltage is determined by the current luminance value for the pixel.

* * * * *